US009779905B2

(12) United States Patent
Kumakhov

(10) Patent No.: US 9,779,905 B2
(45) Date of Patent: Oct. 3, 2017

(54) METHOD AND DEVICE FOR CHANGING THE DIRECTION OF MOVEMENT OF A BEAM OF ACCELERATED CHARGED PARTICLES

(76) Inventor: Muradin Abubekirovich Kumakhov, Moskovskaya Oblast (RU)

( * ) Notice: Subject to any disclaimer, the term of this patent is extended or adjusted under 35 U.S.C. 154(b) by 377 days.

(21) Appl. No.: 14/123,896

(22) PCT Filed: May 25, 2012

(86) PCT No.: PCT/RU2012/000418

§ 371 (c)(1),
(2), (4) Date: Dec. 4, 2013

(87) PCT Pub. No.: WO2012/169932

PCT Pub. Date: Dec. 13, 2012

(65) Prior Publication Data

US 2014/0098919 A1 Apr. 10, 2014

(30) Foreign Application Priority Data

Jun. 8, 2011 (RU) ..... 2011122945

(51) Int. Cl.
*H01J 3/26* (2006.01)
*G21K 1/087* (2006.01)
(Continued)

(52) U.S. Cl.
CPC ..... *H01J 3/26* (2013.01); *G21K 1/02* (2013.01); *G21K 1/087* (2013.01); *H05H 7/04* (2013.01);
(Continued)

(58) Field of Classification Search
CPC ..... H01J 3/26; H01J 3/34; G21K 1/02; G21K 1/087; H05H 7/04; H05H 2007/046; H05H 7/06
(Continued)

(56) References Cited

U.S. PATENT DOCUMENTS 4,588,955 A * 5/1986 Anderson ..... H05H 1/22 376/130
5,138,271 A * 8/1992 Ikegami ..... H05H 13/04 376/121
(Continued)

FOREIGN PATENT DOCUMENTS

JP 2007-3418 A 1/2007
RU 1828382 5/1995
(Continued)

OTHER PUBLICATIONS

Electronics. Encyclopedic Dictionary. Moscow, Publishing House "Sovetskaya Encyclopedia" (p. 339, 357-358, 572).
(Continued)

*Primary Examiner* — Jack W Keith
*Assistant Examiner* — Daniel Wasil
(74) *Attorney, Agent, or Firm* — McDermott Will & Emery LLP

(57) ABSTRACT

A method and a device for changing direction of movement of a beam of accelerated charged particles are based on the use of a curved channel which is made from a material that is able to be electrically charged, and formation of the same kind of charge on an inside surface of the channel wall as that of the particles. Maintenance of a condition that relates an energy and a charge of the particles to geometrical parameters of the channel is required, in particular, a radius R of curvature of a longitudinal axis thereof, and to electrical strength of the wall material. The beam can possibly be rotated through large angles without loss of intensity, significantly simplifying a design, and also reducing the mass and dimensions of all devices, particularly by obviating a need for magnets and supply voltage and control voltage sources for such devices.

8 Claims, 13 Drawing Sheets

Figure 1:
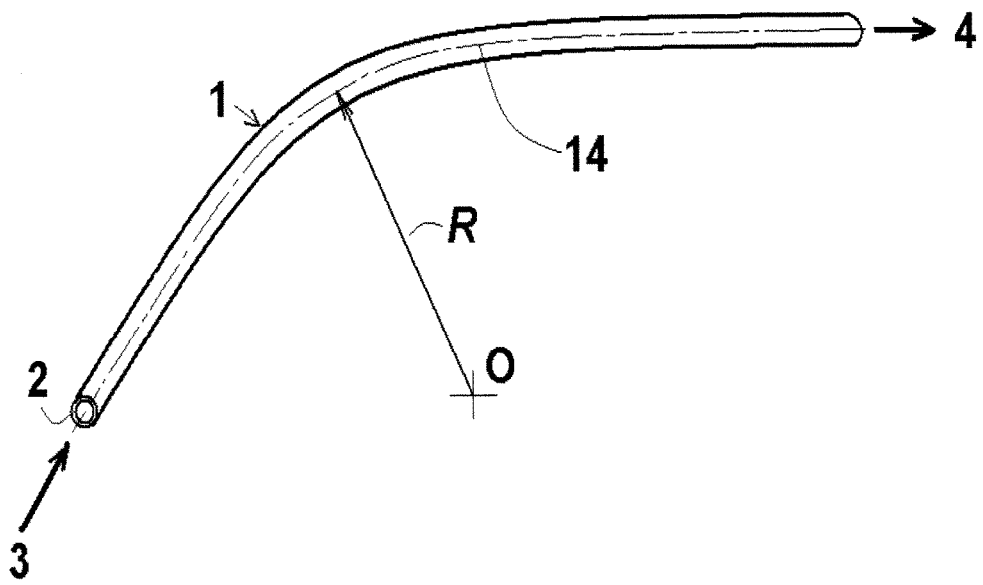

(51) Int. Cl.

| | |
|---|---|
| ***H05H 7/04*** | (2006.01) |
| ***G21K 1/02*** | (2006.01) |
| *H05H 7/06* | (2006.01) |
| *H01J 3/34* | (2006.01) |

(52) U.S. Cl.
CPC ..... *H01J 3/34* (2013.01); *H05H 7/06* (2013.01); *H05H 2007/046* (2013.01)

(58) Field of Classification Search
USPC ..... 376/190, 199; 250/396 R, 398; 315/502, 315/506
See application file for complete search history.

(56) References Cited

U.S. PATENT DOCUMENTS

| | | | | | |
|---|---|---|---|---|---|
| 5,192,869 | A * | 3/1993 | Kumakhov | G21K 1/06 | 376/159 |
| 5,576,593 | A * | 11/1996 | Schultheiss | H05H 5/00 | 250/398 |
| 5,744,813 | A * | 4/1998 | Kumakhov | G21K 1/06 | 378/149 |
| 6,815,688 | B2 * | 11/2004 | Schneiker | H01J 3/022 | 250/396 R |
| 7,659,521 | B2 * | 2/2010 | Pedroni | A61N 5/1049 | 250/398 |
| 7,902,527 | B2 * | 3/2011 | Chen | H01J 37/08 | 250/398 |
| 7,973,290 | B2 * | 7/2011 | Satoh | H01J 37/05 | 250/396 R |
| 2004/0026609 | A1 * | 2/2004 | Kumakhov | G02B 6/04 | 250/250 |

FOREIGN PATENT DOCUMENTS

| | | | | |
|---|---|---|---|---|
| RU | 2187219 | | 8/2002 | |
| RU | 2237297 | | 4/2004 | |
| RU | 46121 | | 6/2005 | |
| RU | 2265974 | | 12/2005 | |
| RU | 2312473 | | 12/2007 | |
| WO | WO 2010/109297 | * | 9/2010 | H01J 3/02 |

OTHER PUBLICATIONS

Physical Encyclopedia. Publishing House "Bolshaya Rossiiskaya Encyclopedia", Moscow, 1998 (vol. 3, p. 241, 406-409; vol. 5, p. 246-253).

N.F.Shul'ga, V.I.Truten, I.V.Krillin. Passage of the Beams of Fast Charged Particles through the Bent Crystal. "Herald of the Kharkiv University", No. 887, 2010, Physical series "Nuclei, Particles, Fields", issue 1 /45/, p. 54-64.

USSR Inventor's Certificate No. 1064792 published Jan. 15, 1985.

The physics of the beams of charged particles and accelerating technique. "News and Problems of Fundamental Physics". State Research Center of the Russian Federation The Institute of Physics of High Energies (Protvino), 2010, No. 1(8), p. 28-39.

K.A. Vokhmyanina. Control of the beams of positive ions using dielectric channels. Dissertation for the degree of the candidate of physico-mathematical sciences. Moscow, MGU, 2007, p. 19-21, 81-96.

Wei Wang, Dejun Qi, Deyang Yu at al. Transmission of low-energy electrons through SiO2 tube. "Journal of Physics: Conference Series", 163 (2009) 012093 (IOP Publishing), p. 1-4.

F.F. Komarov, A.S. Kamyshan, Cz. Karwat. A fine structure in angular distributions of protons transmitted through insulating capillaries. "Vacuum" 83 (2009), p. 551-553.

Reference Manual on Electro-Engineering Materials. Eds. Yu. V. Koritsky, BV.V. Pasynkov, B. M. Tareev. vol. 2, p. 207, fig. 22-11. Moscow, Energoatomizdat, 1987.

A.N. Lebedev, A.V. Shalnov. Basic Physics and Techniques of Accelerators. Moscow, Energoizdat, 1981, vol. 1, p. 6-83, 88, 104-105, 111-114, 120-143; vol. 2, p. 191.

Electrets. Ed. H. Sessler, Moscow, Publishing House "Mir", 1983, p. 32-54.

D. D. Ryutov. Open traps. "Advances of Physical Sciences", Apr. 1988, vol. 154, issue 4, p. 565-614.

N. Stolterfoht et al., "Guided transmission of 3 keV Ne7+ ions through nanocapillaries etched in a PET polymer", Nuclear Instruments and Methods in Physics Research B 203 (2003), pp. 246-255.

* cited by examiner

METHOD AND DEVICE FOR CHANGING THE DIRECTION OF MOVEMENT OF A BEAM OF ACCELERATED CHARGED PARTICLES

The inventions refer to engineering physics and more specifically—to means for controlling the movement of charged particles, providing their acceleration and interaction, and for receiving the radiation occurring during their movement, namely—to the method of changing the direction of movement of a beam of accelerated charged particles (electrons, protons, ions), and the device for realization of this method, as well as to the source of undulator electromagnetic radiation, the linear and cyclic accelerators of charged particles, the collider, and the means of receiving the magnetic field generated by the current of accelerated charged particles, which all are comprising the said device.

Methods are well known and widely spread, wherein, to change the direction of movement of a beam of charged particles, the interaction of the charge of those particles with the charge of the electrodes relatively to which the particles' trajectories go, or interaction of the charge of moving particles with the magnetic field is used. Such methods are utilizes, in particular, in the beam-deflection systems of electron-beam tubes (Electronics. Encyclopedic Dictionary. Moscow, Publishing House "Soviet Encyclopedia" [1], p. 357-358). Similar methods are also used in the devices converting the kinetic energy of a beam of charged particles into the electromagnetic radiation energy, which contain a sequence of alternating electrodes or magnets generating a field, which direction changes periodically along the device (see: Physics Encyclopedia. Publishing House "Comprehensive Russian Encyclopedia", Moscow, 1998 [2], vol. 3, p. 406-409, as well as [1], p. 339). Methods based on controlling a beam of charged particles with the help of magnetic fields are also used in storage rings and cyclic accelerators of charged particles (see [2], vol. 3, p. 241; vol. 5, p. 246-253; also [1], p. 572). The common feature of the said group of methods and devices realizing them is the necessity of external sources of electric voltages and their controls. Hence, realization of such methods requires sophisticated equipment. Especially complex and large in terms of weight and dimensions are the devices where controlled magnetic fields are used. Nevertheless, such methods and devices allow beam veering at large angles providing movement of charged particles along intricately shaped bent trajectories.

Another group of the methods of changing the movement direction of a beam of charged particles and devices realizing them is known. One of the methods of that group envisages use of a bent crystal and channeling charged particles inside its interfacial gaps (N. F. Shul'ga, V. I. Truten', I. V. Kirillin. Passage of the Beams of Fast Charged Particles through the Bent Crystal. "Herald of the Kharkiv University", No. 887, 2010, Physical series "Nuclei, Particles, Fields", issue 1/45/, p. 54-64 [3]). In the example given in paper [3], the angle of veer of a beam of positively charged particles equaled to 250 microradians. The USSR inventor's certificate No. 1064792 [4] (published 15 Jan. 1985) describes the method and the device based on that principles, which allow turning separate parts of the initial beam at different angles and then bringing them together to achieve focusing. However, as mentioned in the inventor's certificate [4], about 5% of particles of the initial beam only can be exposed to the transformation mode. Besides, utilization of interfacial gaps of a crystal for transportation of particles imposes significant limitations on the time the particle stays in the channel due to scattering on electrons and thermal oscillation of lattice atoms. For example, at about 1 GeV energies of electrons in the beam, the characteristic channeling length is close to 1 micron; that is the transported particles de-channelize very quickly. Other methods and devices of this group use several sequential reflections from bent or straight crystals to turn a beam of particles. In the first case, several sequential reflections of charged particles in the area tangent to the bent atomic plane resulting in particles' deviation in the opposite direction relative to the bent are used (Physics of the Beams of Charged Particles and Acceleration Equipment. "News and Problems of Fundamental Physics". State Research Center of the Russian Federation, the Institute of High-Energy Physics (Protvino), 2010, No. 1(8), p. 28-39 [5]). However, the efficiency of such devices in turning ion beams drops drastically with increase of the beam veer angle (for instance, for a proton beam: 0.1 at 0.6° veer angle to 0.001 at 4.5° angle). The common advantage of this group of methods and devices consists in their completely passive nature, requiring neither electric power supply nor controls.

Further, a group of methods and devices is known, in which the change of movement direction of a beam of charged particles is achieved through its transmission through a straight dielectric channel having a round cross-section, which is adjusted at an angle to the direction of the initial beam of particles (see: N. Stolterfoht, V. Hoffmann, R. Hellhammer at al. Guided transmission of 3 keV $Ne^{7+}$ ions through nanocapillaries etched in a PET polymer. "Nuclear Instruments and Methods in Physics Research Section. B: Beam Interactions with Materials and Atoms", Volume 203, April 2003, p. 246-253 [6]). Such methods and devices are characterized by strong dependence of transmission on the veer angle: at a 20° veer, the intensity of the beam of particles at the outlet from the channel is two orders smaller than at the inlet. This group includes also the method and device described in [7] (K. A. Vokhmyanina. Controlling the Beams of Positive Ions Using Dielectric Channels. Dissertation for the degree of candidate of physico-mathematical sciences. Moscow, MGU, 2007), p. 81-96. The device represents a pair of parallel dielectric wafers, a gap between which forms a channel for charged particles' transportation. Beam veer can be implemented by one of the two options. The first option does not substantially differ from that described in [6]: the afore-mentioned channel, that is the planes of the said parallel wafers, is adjusted at an angle relatively to the direction of the initial beam. According to the second option, the beam is first transmitted through the channel wherein the said planes are aligned parallel to the beam direction. Then both planes are turned at some angle round the axis perpendicular to them. At small angles (of the order of 1°–2° of planes' veer, the beam at the outlet from the channel becomes veered almost at the same angle. This method cannot be considered convenient, because, in contrast to the previous method, at the channel outlet it is necessary first to obtain a beam which direction coincides with the initial direction; that is the device cannot be immediately arranged so as to obtain a beam having the required direction. Besides, the achievable veer angles are small. Exclusive of the said inconvenience of the last method, the common positive feature of this group of methods and devices, same as of the previous one, is that they require neither electric power supply nor sophisticated controls.

Other methods and devices for changing the direction of a beam of accelerated charged particles, which feature similar advantages, are known as well. The methods and devices of this group are described in Japanese patent application No. 2005-185522 [8] (published 11 Jan. 2007) and paper: Wei Wang, Dejun Qi, Deyang Yu at al. Transmission of low-energy electrons through $SiO_2$ tube. "Journal of Physics: Conference Series", 163 (2009) 012093 (IOP Publishing), p. 1-4 [9]. In both methods, the change of the movement direction of a beam of charged particles is provided by way of beam transporting through a bent capillary channel. In this instance, according to the application [8], transporting is done via a taper channel narrowing down from the inlet to the outlet, and according to paper [9]—via a channel having a constant diameter. The factor determining the possibility of transporting beam through a channel, in the methods of this group (same as in the previous group of methods), is the presence of electrization of the dielectric channel wall. In application [8] there are no data concerning transmission (the ratio between currents of the incoming and outgoing beams). However, it follows from the results of experimental investigations of taper capillaries obtained independently by different specialists and given in [7] (p. 19-21), that even in the absence of bending the transmission does not exceed a few percent. It should be even less in a taper capillary according to the afore-mentioned application [8], which is bent. This is supported by the fact that transmission of a bent channel, even in case of constant diameter, is rather small. According to [9], at an angle of curvature equal to 15°, the currents in the outgoing and initial beams equal to about 18 nA and 4.1 μA, respectively, that is the transmission is less than 0.5%. This beam veer angle, though larger than in the methods of the previous group, is still small. Besides, the possibility of channel blocking phenomenon has been established, which consists in that the outgoing beam becomes interrupted in time (see: F. F. Komarov, A. S. Kamyshan, Cz. Karwat. A fine structure in angular distributions of protons transmitted through insulating capillaries. "Vacuum" 83 (2009), p. 51-53 [10]). The blocking possibility is also noted in patent application [8]. Blocking may evidently occur also during beam transportation via a bent channel of constant diameter that is used in the method according to [9], since it results from excessive charge accumulation on the channel wall, which prevents beam passing to the outlet. Therefore, the problem of creating a method and a respective device capable of veering a beam at a larger angle at higher transmission is aggravated by the necessity of eliminating the channel blocking phenomenon.

The most close to the suggested method of changing the direction of a beam of charged particles is the method described in paper [9] envisaging use of a bent channel with a constant cross-section size along its length.

The suggested invention referring to the method of changing the movement direction of a beam of accelerated charged particles is aimed at accomplishment of the technical result consisting in providing beam veer at an arbitrary angle with concurrent increase of the fraction of the initial beam particles retained in the veered beam and eliminating beam interruptions, preserving the simplicity inherent with the methods of the last of the groups discussed above.

In the suggested method of changing the movement direction of a beam of accelerated charged particles, same as in the said most close hereto known method according to paper [9], veer of the said beam is realized by way of its injection into a channel having a bent longitudinal axis, its wall being made of material capable of electrization. The beam is transported via the said channel in the presence of its' wall electrization with charge having the same sign as the charge of the beam of particles.

For accomplishment of the said technical result, the suggested method, in contrast to the closest known method, uses a channel with a longitudinal axis having a smooth line shape and transportation of accelerated charged parties via this channel is performed observing the following correlation connecting energy E and charge Q of the beam particles with electrical strength $U_{es}$ of the wall material and geometric parameters of the channel—the smallest radius R of curvature of the longitudinal axis, the smallest thickness d of the wall and the greatest distance h between two points of the channel's internal surface located in the channel's cross section on the same normal line to the said surface:

$$E/Q<RdU_{es}/h. \quad (1)$$

The physical values included in correlation (1) are expressed in SI units, that is [E]=J, [Q]=C, $[U_{es}]$=V/m, [R]=[d]=[h]=m. If energy E is expressed in off-system units—electron-volts as may be the case in the pertinent art, charge Q should be expressed in the quantity of elementary charges (that is electron charges), which it is divisible by.

Provided the condition (1) is observed, the beam moves along the channel "squeezing" against the side of the internal surface of the channel wall, which is most distant from the centre of curvature of its longitudinal axis, but not colliding with wall. Thanks to this, no accumulation of excessive charge on the wall that would have prevented particles' passing through the channel decreasing the current as the beam is moving along the channel and that might have led to its blocking takes place. The beam moving through the channel acquires a cross-sectional size that is smaller than the channel opening's cross-section, that is, it is focused. There are no limitations in respect of the beam veer angle (the angle of twisting of the channel's longitudinal axis when the channel is bent), subject to observance of condition (1). More detailed analysis of the structure of beam in the channel shows existence of a wave-shaped nature of particles, movement, which periodically approximate the channel wall and move away from it.

The beam, veered using the method described, can be used both after it goes out of the channel and when it is inside the channel. In the first case, it can be targeted to the required site by selection of the necessary shape of the channel; in the second case, it can be, for instance, accelerated and (also with respective selection of the shape of the channel) may be a source of electromagnetic radiation. Various options of combining the said ways of using the beam subjected to veer according to the suggested methods are possible. Some of them will be mentioned below in the description of the device for realization of the suggested method and other devices it is comprised in.

The closest to the suggested device for changing the direction of a beam of accelerated charged parties is the device known from paper [9], which represents a bent glass channel with a constant along the length cross-section.

The suggested invention pertaining to the device for changing the direction of movement of a beam of accelerated charged particles is aimed at accomplishment of the technical result consisting in provision of the beam veer at an arbitrary angle with simultaneous increase of transmission and prevention of the channel blocking phenomenon. Besides, the design of the suggested device allows obtaining virtually any shape of the longitudinal axis of the channel in the form of a smooth line (and respective form of the trajectory of a beam of particles), without the necessity in special equipment for creation of magnetic fields curving trajectories of particles, in contrast to the devices of the first group among those discussed an intricately shaped beam trajectory. Below, in the disclosure of the suggested invention and the description of its realization in different particular cases, these types of the technical results will be specified; also some other types of the accomplished technical result will be mentioned.

The suggested device for changing the direction of movement of a beam of charged particles according to the suggested method, same as the closest hereto known device described in paper [9] (see above), contains a channel with a bent longitudinal axis for transportation of the said particles, which wall is made of a material capable of electrization by the charge having the same sign as the transported particles.

To achieve the said technical result, in the device according to the suggested invention, in contrast to the closest known device, the said channel is made with the longitudinal axis having the form of a smooth line, the smallest radius R of curvature of which is related to the highest energy E and the charge Q of the beam of particles, working with which this device is designated for, by the following correlation including also the smallest thickness d the channel wall, the electrical strength $U_{es}$ of the channel wall material, and the longest distance h between two points of the internal surface of the channel, which are located in the channel cross-section on one and the same normal line to the said surface:

$$E/Q<RdU_{es}/h. \quad (2)$$

The physical values included in correlation (2) are expressed, as in correlation (1), in SI units, that is [E]=J, [Q]=C, [$U_{es}$]=V/m, [R]=[d]=[h]=m. If energy E is expressed in off-system units—electron-volts, as it might be the case in this art, then charge Q should be expressed in the quantity of elementary charges (i.e. electron charges), which it is divisible by. This remark applies to all similar correlations used below in the characterization of other suggested devices comprising the suggested device for changing the direction of movement of a beam of accelerated charged particles.

In a particular case, the internal surface of the channel wall may have a round cross-section. In this instance, value h in correlation (2) is equal to the largest of all values that may have the diameter of the said cross-section (since they can vary along the channel length).

In another particular case, the internal surface of the wall channel is formed by two planar surfaces and its cross-section looks like two segments of parallel straight lines (the planar surface is commonly understood as the surface obtained as a result of bending a plane round an axis parallel to it or round several such axes parallel to each other). In this instance, value h in correlation (2) is equal to the longest distance between the said planar surfaces (since this distance may vary along the channel length).

The described make of the suggested device subject to observance of correlation (2) provides realization of the suggested method in the use of the device. Thanks to this, high transmission of the device is accomplished and it is possible to make it with such curvature of the axial line, at which the veer angle of the beam moving in the channel is in practice unlimited. Besides, channel blocking does not happen.

Electrization of the internal surface of the wall channel occurs when the device is started, and during operation—as a result of recharging of that surface (replacement of the few escaping charges with new charges received from the transported beam). Electrization may be also achieved as a result of the surface pre-charging, in particular, when channel wall is made using the materials possessing the properties of electrets. Existence on the channel walls of the said charges having the same sign as the particles of the beam injected into the channel, subject to observance of condition (2), provides the possibility of charged particles' movement without channel blocking and without contacting its wall (of course, use of the suggested device same as all aforementioned and other known and suggested means having the purpose under discussion, is exercised in the conditions providing movement of charged particles in deep vacuum).

The beam, which particles initially have a velocity directed mostly (depending on the divergence of the initial beam) in parallel to the tangent to the longitudinal axis of the channel in inlet opening, acquires in the course of further movement along the channel the transversal size that is less than the cross-section of the channel opening, that is it is focused thanks to the action rendered on the beam particles by the electrical field created by the like-charged wall of the channel. Existence of wall electrization subject to concurrent fulfillment of condition (2) allows the beam to overcome channel bents also without contacting its wall. In this instance, the beam moves through the bent channel "squeezing" against the side of the internal surface of the channel wall that is the most distant from the centre of curvature of the longitudinal axis, but without colliding with the wall. Thanks to this, there is no accumulation of excessive charge on the wall, which would have prevented particles' passing through the channel reducing the current as the beam was moving through the channel and could have blocked it.

In the suggested device, the channel can be made both not closed and closed. In the first case, it has the inlet and outlet but-ends with the inlet and outlet openings, respectively. Such channel is used both on its own and as art of some of the devices suggested below.

In the device with a non-closed channel, the latter, at least in a part of its length, can be made flexible. In this instance, its part adjacent to the inlet butt end is rigidly fixed while the remaining part is left flexible.

Such device can be equipped with a means for controlled bending of the non-fixed flexible part of the channel.

The means for the controlled bending can be made, for instance, as one or two mutually orthogonal piezoelectric bending elements mounted on the said non-fixed flexible part of the channel and connected to the source of control signal.

The means for controlled bending can be also made as one or two mutually orthogonal couples of ferromagnetic elements mounted on the non-fixed part of the channel length, and an electromagnetic system for changing the position of the part that is connected to the source of control signals.

The channel of the suggested device, both in the case when its shape is fixed and when it is made flexible (in the latter case—both in the presence and in the absence of means for controlled bending), can be provided with a target to excite in the target's material of characteristic x-ray radiation in the channel part adjacent to its outlet butt-end. The target can be placed in the outlet butt end of the said channel closing its outlet opening. In this instance, it represents transmission anode. The target can be also made as the coating with the target material of the internal surface of the channel wall part adjacent to its outlet butt end.

Besides, the target can be made as the coating with the target material of the internal surface of the channel wall part being at some distance from its outlet butt-end. In this instance, the part between such coating and the outlet butt-end forms a channel for x-ray transportation with multiple total external reflections. X-ray radiation, as a result of passing through such channel, is collimated to form a 'pencil" x-ray beam.

In the described specific cases of realization of the channel of the suggested device with the target, the device can be used to generate beams of charged particles and x-rays with controlled direction, or beams of fixed direction oriented as required.

Together with the other afore-mentioned cases of realization of the channel of the suggested device, all above-stated allows assessing the diversity of use of the said device in x-ray sources, systems for electronic, ion and radiation diagnosis and therapy, means for micro-probing of materials, and other applications.

As has been mentioned above, the suggested device for changing the direction of movement of a beam of charged particles may be a component part of other devices, such as, in particular, the inventions of the suggested group of inventions described below: the source of electromagnetic radiation, the linear and cyclic accelerators of charged particles, the collider, the means for obtaining magnetic field generated by the current of accelerated charged particles.

Sources of electromagnetic radiation are known, where radiation referred to as undulator is generated in the course of movement of precharged particles along a periodically curved trajectory in alternating magnetic field ([2], vol. 3, p. 406-409). Such sources are characterized by use of intricate magnetic system, which adversely affects their weight and dimensions.

Russian Federation patent for invention No. 1828382 [12] (published 20 May 1995) describes the undulator where the movement of accelerated charged particles along a periodically curved trajectory is provided with the help of the magnetic system made as two serpentine-shaped conductors arranged one above the other in two parallel planes and forming two symmetrical poles, wherein the conductors have rectangular cross-section and the size of each conductor in the pole plane is larger than its size in the perpendicular direction. The magnetic system in that source is simpler compared to the classical case described in [2], but its very presence is a factor making the device more complex. Sources of undulator electromagnetic radiation are also known, wherein bending of the trajectory of accelerated particles is provided with the help of alternating electrical fields (see [2], p. 406); but in this instance, magnetic fields are also used concurrently for beam focusing. Due to presence therein of means creating such fields, such devices are also complex.

The suggested invention referring to the source of undulator electromagnetic is aimed at accomplishment of the technical result consisting in design simplification thanks to provision of the movement of a beam of charged particles along a curved trajectory with the beam focusing retained without using, for this purpose, any means creating magnetic fields.

The common feature of the suggested source of undulator electromagnetic radiation and any of the above-mentioned known sources (the closest, in terms of design simplicity, to the source described in patent [12]), is the presence of means to form the accelerated charged particles' trajectory having bends and to focus the beam of accelerated charged particles moving along that trajectory.

To accomplish in the said technical result, the suggested source of undulator electromagnetic radiation, in contrast to the said closest known source, the functions of the said means to form the accelerated charged particles' trajectory having bends and to focus the beam of accelerated charged particles moving along that trajectories are combined in the device for changing the direction of movement of the beam of accelerated charged particles, which includes the channel with a bent longitudinal axis for transportation of the said particles, the wall of which is made of the material capable of electrization. The said channel is made with its longitudinal axis shaped as a smooth line, the least radius of curvature of which is related to the maximal energy E and the charge Q of the particles of the beam, for which this source of electromagnetic undulator radiation is designed for, by the following correlation including also the least thickness d of the channel wall, electrical strength $U_{es}$ of the channel wall material, and the longest distance h between two points on the internal surface channel, which are situated in the transversal cross-section of the channel on one and the same normal to the said surface:

$$E/Q<RdU_{es}/h. \quad (3)$$

As has been mentioned in the description of the suggested method and device for changing the direction of movement of a beam of accelerated charged particles, the beam, moving through the channel, which wall is electrized by charge of the same sign as the transported particles, is focused. In this instance, its trajectory is determined by the shape of the said smooth line, which the channel's longitudinal axis has and which is chosen with regard to the necessity of generating undulator electromagnetic radiation. So, thanks to such nature of movement of the beam of particles that is possible subject to observance of condition (3), the shape of the particles' trajectory is determined solely by the geometry of the channel, which explains the absence of any need in any additional means to control the beam and, consequently, the simplicity of the source of radiation under discussion.

Existence of curvature of the charged particles' trajectories when they move through the bent channel leads to generation of undulator electromagnetic radiation, same as in conventional undulators. At the same time, it is possible to influence the spectral properties of the radiation produced by making bent channel with this period of bends of its longitudinal axis or other and obtain radiation of a wider spectrum by making the bent channel with varying, along the channel length, distance between neighboring bents of its longitudinal axis.

The next one of the suggested devices comprising the suggested device for changing the movement direction of accelerated charged particles is linear accelerator of charged particles.

The linear accelerator of charged particles is known, which contains an evacuated channel where paths with accelerating electric fields have been created (A. N. Lebedev, A. V. Shalnov. Basic Physics and Engineering of Accelerators. Moscow, Energoizdat, 1981, vol. 1 [13], p. 120-143). Particles are accelerated passing such paths multiple times. Such accelerators usually also containing means to focus the beam of accelerated particles are usually capital facilities having extremely large longitudinal dimensions and high price. These factors make their application in research laboratories and medical institutions practically impossible.

The accelerator according to the Russian Federation patent for invention No. 2312473 [14] (published 10 Dec. 2007) is also known, which contains the accelerating tract made as several accelerating sections each having a rectilinear channel, which are connected in sequence using bent sections containing deflection magnets. In the said sections, magnetic focusing of the beam of particles transported via the tract is also performed. Such design of the accelerator enables movement of accelerated particles along a trajectory with smooth bents, for instance, by 90 degrees, which results in a zigzag or serpentine shape of the accelerator. In spite of existence of the particles' trajectory, such accelerator is linear since the velocity of particles' movement in it is increased in the course of one-time passage along the tract formed by sequentially connected sections rather than in the course of their cycling movement. Thanks to the described make of that accelerator, its largest dimension can be reduced compared to the conventional rectilinear accelerator. However, its inclusion of beam-focusing magnetic means and deflection magnet sections makes it more complex and expensive.

This known linear accelerator is the closest one to the accelerator according to the suggested invention aimed at accomplishment of the technical result consisting in making the device design simpler and cheaper thanks to elimination of magnetic systems for focusing the beam of particles and changing the direction of their movement, and eventually—in ensuring the possibility of using the accelerator in research laboratories and medical institutions.

The suggested linear accelerator of charged particles, same as the afore-mentioned closest to it accelerator known from patent [14] contains an accelerating tract having smooth bents and means to focus the beam of charged particles in the course of their movement via that tract, also means for increasing the movement speed of the beam of charged particles, which are arranged along the accelerating tract.

To achieve the said technical result, in the suggested accelerator, in contrast to the closest to it known accelerator, the said accelerating tract with means for focusing the beam of charged particles in the course of their movement via that tract is made as a device for changing the movement direction of the beam of accelerated charged particles, containing a channel with a bent longitudinal axis for transportation of the said particles, which wall is made from the material capable of electrization. The said channel is made with its longitudinal axis shaped as a smooth line, which least radius R of curvature is related to the highest energy E and the charge Q of the beam of particles, for operation with which the linear accelerator is designed, by the following correlation including also the lest thickness d of the channel wall, electrical strength $U_{es}$ of the channel wall material, and the longest distance h between two points of the channel internal surface located in the channel cross-section on the same normal to the said surface:

$$E/Q<RdU_{es}/h. \quad (4)$$

As has been mentioned above in the description of the suggested method and device for changing the movement direction of a beam of accelerated charged particles, the beam, moving through the channel which wall is elektrized by similarly positive or negative charge as the transported particles, is being focused. In this instance, the form of its trajectory is determined by the shape of the said smooth line that the channel's longitudinal axis has and that is selected in this case based on considerations of reducing the accelerator's dimensions with regard to the necessity of observing condition (4). Thanks to the latter, the bents of particles' trajectories allowing reducing the accelerator dimensions are determined solely by the channel geometry, which explains absence of any need in additional means to control the beam and, consequently, the simplicity of the linear accelerator under discussion.

At that, the greatest simplicity takes place when the means for increasing the velocity of charged particles' movement along the said channel are made electrostatic as electrodes of opposite polarity arranged in pairs one after one and spaced along the channel. The first electrode in each pair in the direction of particles' movement should be the electrode having the polarity that is opposite to the sign of the charge of particles being accelerated.

The said smooth line (that is the longitudinal axis of the said channel which is the accelerating tract), may have, in particular, a serpentine shape, the shape of a helical spiral, or a spiral wound over the torus surface.

The noted specific features of the suggested linear accelerator allow achieving the weight and dimensions parameters that are acceptable for a wide application of such accelerator in research laboratories and medical institutions.

Cyclic accelerators of charged particles are known, which contain an electromagnet, an accelerating chamber closed as a ring, an injector, an accelerating resonator, and respective power supply systems ([2], vol. 5, p. 246-253). Such accelerators have very large mass, are characterized by a complex and expensive technology of manufacturing the electromagnet, accelerating chamber, labor-intensive technology of installation of the whole plant, as well as the necessity of using special power supply sources for the electromagnet and resonator.

The 'iron-free' synchrotron accelerator according to the Russian Federation patent for invention No. 2265974 [15] (published 10 Dec. 2005) is also known. In that accelerator, the closed accelerating chamber is made as alternating sections that are parts of the ring, and rectilinear sections. Each of the sections that are parts of the said ring is made of two concentrically arranged conducting bands forming two walls of the section and connected dielectric rings that are parallel one relative to the other, which form the other two walls. Some ends of conducting bands in each section are electrically interlinked while the other are designed for connection to opposite poles of the power source. When the sections designed as described above are connected to the source they perform the electromagnet function and provide beam focusing. Rectilinear sections are used for injection and removal of charged particles and for accommodation of accelerating resonators.

The cyclic accelerator known from patent [15] is the closest one to the suggested accelerator. That 'iron-free' accelerator, in spite of the fact that it is considerably lighter and easier than the classical one, is still structurally and technologically complex, has large weight and dimensions, and requires special power supply and control means to ensure correct operation of the electromagnet.

The suggested invention referring to the cyclic accelerator of charged particles is aimed at accomplishment of the technical result consisting in improvement of the weight- and dimensions parameters and simplification of the technology of manufacture thanks to absence in its design of the said complex means.

The suggested cyclic accelerator of charged particles, same as the closest to it known accelerator, contains a closed accelerating chamber with means for focusing a beam of charged particles in the course of their movement in this chamber equipped with the means for increasing the speed of charged particles' movement, also the injector for injecting into the said camera of the initial beam of preliminarily accelerated charged particles.

To accomplish the said technical result, in the suggested cyclic accelerator, in contrast to the closest to it known accelerator, the said closed accelerating chamber with means for focusing a beam of charged particles in the course of their movement in this chamber is made as a device for changing the movement direction of the beam of accelerated charged particles containing a bent channel for transporting the said particles, the wall of which is made of a material capable of electrization. The said channel is made with its longitudinal axis shaped as a smooth line, the least radius R of curvature of which is related to the highest energy E and the charge Q of the particles of the beam, for work with which this cyclic accelerator is designed for, by the following correlation that also includes the least thickness d of the channel wall, electrical strength $U_{es}$ of the channel wall material, and the largest distance h between two points of the inner surface of the channel situated in the channel cross-section on the same normal to the said surface:

$$E/Q<RdU_{es}/h. \quad (5)$$

At that, the said channel is made closed as a ring.

As has been mentioned above in the description of the suggested method, the beam, moving through the channel which wall is electrized by the charge of the same sign as the transported particles, is being focused. In this instance, the shape of its trajectory is determined by the shape of the said smooth convex line that the channel longitudinal axis has and that is closed in this instance, and its curvature is chosen with regard to the necessity of observing condition (5). Thanks to the latter, bending of particles' trajectories and giving them the closed nature is accomplished solely through the channel's geometry, which gives rise to the absence of necessity in any additional beam control means and, hence, the simplicity of the cyclic accelerator under discussion. At that, the greatest simplicity takes place when the means for increasing the speed of charged particles' movement along the said closed channel are made electrostatic as electrodes of opposite polarity arranged in pairs one following the other and spaced along the channel. In each pair the first electrode in the direction of particles' movement should be the electrode, which polarity is opposite to the sign of the charge of the particles being accelerated.

Such make of the cyclic accelerator is preferable, when the smooth line that the channel's longitudinal axis is shaped as is convex. Besides, it is expedient to place the injector so that it would be possible to inject the accelerated charged particles of the initial beam into the channel on the side of the ring formed by this channel, which looks toward the center of curvature of its longitudinal axis. This is explained by that in the course of movement along the closed curvilinear trajectory, the beam particles "squeeze up" against the peripheral (that is the most distant from the center of curvature) side of the inner surface of the wall of the channel being the accelerating chamber. In order to have the said "squeezing" always against the same side of the wall, i.e. to avoid beam trajectory contraflexures (changes of the sign of curvature), such make is preferable when the smooth line that the channel longitudinal axis is shaped as is convex. The said preferable location of the injector is also connected with the noted circumstance. Injection of the initial beam particles into the channel on the side that is opposite to the side against which the beam is "squeezed" reduces the probability that the particles already present in the channel and making cyclic movement would escape from it through the hole made to connect the channel to the injector.

To use the discussed cyclic accelerator as a source of charged particles, on the side of the ring formed by the said channel, which looks toward the side that is opposite to the center of curvature of its longitudinal axis, a source can be installed to form a beam of charged particles having the same sign as the accelerated charged particles. This source should be installed so that the said beam would be directed toward the wall of the ring-shaped channel in the required zone of removal of particles from it.

The cyclic accelerator described above is concurrently a source of electromagnetic radiation. The obtained electromagnetic radiation may have frequencies (wavelengths) is a rather wide range depending on the speed (energy) of charged particles. In case of non-relativistic speeds, the smaller is the energy the closer is the radiation to the radio range, and in case of relativistic speeds—the higher is this energy the closer is the radiation to x-rays and harder. By analogy with the known sources of electromagnetic radiation using accelerators with the magnetic principle of controlling the trajectories of charged particles, the radiation obtained in the first case can be referred to as cyclotron and in the second case—synchrotron.

When the cyclic accelerator under discussion is used as a source of electromagnetic radiation, it should be enclosed in a housing that is not transparent for the generated radiation, in which radiation outlet windows are made.

At that, if the cyclic accelerator is used to produce synchrotron radiation, the said channel made as a ring may have variable curvature along its axial line. This allows obtaining synchrotron radiation of different frequency. In this instance, the afore-mentioned radiation outlet windows are made in the housing parts corresponding to the parts of the said ring-shaped channel featuring different curvature.

Another device, as a part of which the suggested device for changing the movement direction of a beam of accelerated charged particles can be use is the collider, an installation designed for performance of collisions of counter beams of accelerated charged particles.

From monograph [13] (p. 111-114) a device is known (a collider according to the modern terminology) providing interaction of beams of charged particles, which contains one closed ring-shaped tract or two crossing or touching each other with longitudinal axial lines ring-shaped tracts, and the means for injection of the said beams. That known collider has huge geometrical sizes (from hundreds of meters to tens kilometers) and weight, huge energy consumption, in particular, due to presence therein of ring electromagnets (in a number of cases—superconducting at a temperature close to absolute zero), and require extremely complex controls.

Patent [16] (the Russian Federation patent for invention No. 2187219, published 10 Aug. 2002) describes a collider containing two systems for transportation and acceleration of particles, which are made as polygonal channels. For passage from each side of the polygon to the next one, deflecting magnetic dipoles (coils) are provided for, while the possibility of interaction between particles of the beams transported in the said systems is ensured by that the said polygons have a common side. As noted in the description of patent [16], this collider features considerable advantages in terms of dimensions, energy consumption and other parameters. However, the said magnetic dipoles should be connected to the devices referred to in patent [16] as "power sources on the basis of the effects of infinite amplification", the design of which is not disclosed in the patent and there is no reference to the public source containing such disclosure. Besides, that collider is not free of the necessity of using magnetic fields during its functioning. These circumstances lower the evaluation of prospects for that collider.

From patent [17] (the Russian Federation patent for invention No. 2237297, published 27, Apr. 2004), the means is also known, which is capable of performing the collider functions. In that means, the interaction of counter-directed beams of accelerated particles is realized through their channeling through interplanar spacing of the crystal. That means is free of the above-mentioned drawbacks of colliders described in [13] and [16]. However, the particles of counter beams in that means pass one relative to another only once, which does not assist increasing the probability of their interaction.

Besides, from patent [18] (the Russian Federation patent for utility model No. 46121, published 10 Jun. 2005), the collider is known that is made as a rectilinear dielectric channel, through which beams of charged particles, which interaction is required to accomplish, are passed. In that collider, same as in the means according to patent [17], the particles of counter beams pass one relative to another only once, which prevents increasing the probability of their interaction.

With regard to the above factors, the classical collider known from monograph [13] is the closest one to the suggested means for controlling beams of charged particles with creation of conditions for interaction between particles belonging to different beams (collider).

The suggested invention referred to the collider is aimed at accomplishment of the technical result consisting in considerable simplification of the design and control thanks to absence of the necessity of using magnetic fields, sources for their power supply (and generally absence of the necessity of using power supplies to control charged particles' trajectories), also in retaining the possibility of multiple passage of the particles of two beams one relatively to another at much smaller geometric sizes of the equipment. This result is combined with considerable increase of luminosity in the course of beams' interaction, which creates preconditions for collider use in performance of thermonuclear reactions. Below, in the disclosure of the essence of the suggested collider and specific cases of its make, other types of the accomplished technical result will be mentioned as well.

The suggested collider for controlling beams of charged particles with creation of the conditions for interaction between particles belonging to different beams, same as the closest to it known one, contains one closed ring-shaped tract or two crossing or touching each other with their longitudinal axial lines ring-shaped tracts, and the means for injecting the said beams.

To accomplish the above-mentioned technical result, in the suggested collider, in contrast to the closest to it known one, each of the said tracts is made as a device for changing the movement direction of the beam of charged particles, which contains the bent channel for transporting the said particles, which wall is made of the material capable of electrization. The said channel is made with its longitudinal axis shaped as a smooth line, the least radius R of curvature of which is related to the highest energy E and the charge Q of the beam particles, for operation with which this collider is designed for, by the following correlation including also the smallest thickness d of the channel wall, electric strength $U_{es}$ of the channel wall material, and the longest distance h between two points of the inner surface of the channel, which are situated in the channel cross-section on the same normal to the said surface:

$$E/Q<RdU_{es}/h. \quad (6)$$

At that, the said channel is made closed as a ring.

On the inner surface of the wall of the channel (channels) there are charges formed as a result of such surface being charged by the charges hitting it as the device is started, or as a result of pre-charging. In the course of operation, this surface can be recharged (when the escaping charges are replaced with new charges received from the transported beam). Presence on the channel walls of the said charges having the same sign as the charges of the beam (beams) injected into the channel, subject to observance of condition (6), enables movement of the charged particles without channel blocking and without contact with the wall.

Under the action of the electrical field created by the charged inner surface of the channel wall enclosing the beam and rendering a compression effect on the beam, the focusing of the beam takes place. Increased particles' density in both interacting beams provides increased luminosity of the collider. In this instance, since the beam particles move along a curvilinear trajectory, in the process of movement the beam gets closer to the side of the channel inner wall that is more distant from the center of curvature of the ring-shaped channel (it is "squeezed" against the wall but does not contact it).

In this connection, such collider design is preferable, wherein the smooth line, which shape, being the shape of the longitudinal axis of the channel (both channels when the collider contains two ring-shaped tracts crossing or contacting each other with axial lines), is convex. Thanks to that, the said "squeezing" occurs always against the same wall of the channel and the beam trajectory has no contraflexures (change of the sign of curvature). Preferable location of the injector enabling injection into the channel of charged particles of the initial beam on the side opposite to the side against which the beam is "squeezed" (i.e. on the side facing the center of curvature of the longitudinal axis of the channel) is also connected with the afore-mentioned circumstance. This reduces the probability of 'escape' from the channel, through the hole made for connection of the channel with the injector, of the particles that are already there making cycling movement.

The condition of the convex shape of the smooth line being the shape of the longitudinal axis of the channel is met, in particular, by a circumference, ellipse, convex polygon with smoothly connected sides.

The shape of the beams' trajectory is determined by the shape of the said smooth line, which is the shape of the longitudinal axis of the channel and which is closed in this instance, and its curvature is selected with regard to the necessity of fulfilling condition (6). Thanks to that, bending of particles' trajectories and making them closed is achieved solely through the channel geometry, which preconditions absence of any need in any additional beam controlling devices and, hence, the simplicity of the subject collider.

In one of the options of making the suggested collider providing for use of one ring-shaped channel only, both beams are injected in the same channel and interaction between the particles belonging to them occurs in that channel. In another option of making the suggested collider providing for use of two ring-shaped channels crossing or contacting each other with their longitudinal axial lines, particles of different beams move along different ring-shaped channels and their interaction occurs in the space that is common for both channels.

The collider described above allows, in contrast to the closest to it collider known from monograph [13], realizing interaction in the same (sole) ring-shaped channel of two beams having a charge of the same sign. At that, the beams can both have counter and same direction (in "pursuit" of each other), since the action of the electrical field created by the charges, which are present on the channel wall, on the particles of the same sign does not depend on the direction of their movement.

Beams with particle charges of the same sign may also be injected into different channel, and it is possible to ensure interaction of both counter and similarly directed beams in the points of crossing or contacting the channels. Beams of particles with charges having different polarity should be injected into different channels. In this instance, same as for the beams of particles with charges of the same sign, it is possible to provide interaction of both counter and similarly directed beams.

The suggested collider may be used, in particular, to obtain intensive thermonuclear neutrons at collision of deuteron and tritium ion beams. In this case, in order to prevent the undesirable alteration of the properties of the material from which the channel walls are made (one channel in the first option or two channels in the second option), caused by possible heating of channel walls in the course of collider operation, the latter may be equipped with means for their cooling, for instance, by supplying external coolant onto them.

The collider, which is a source of neutrons, can be used for transmutation of long-lived radioactive waste. In this instance, the container for such waste is placed in the zone of most intensive release of neutrons.

When beams of particles (having both the same and opposite sign) are injected into different channels, in both possible types of their interaction (both counter and similarly directed beams), additional acceleration of particles of both beams can be realized. The acceleration can be also performed for the particles of similarly directed beams of the same sign injected in the same channel.

Acceleration may be realized, in particular, with the help of electrostatic acceleration sections made as electrodes of opposite polarity arranged in pairs along the channel. In this case, in each pair the first electrode in the direction of particles' movement should be the electrode having an opposite polarity than the charge of particles in that channel.

In a specific case of make when the collider contains only one ring-shaped channel and interaction of charged particles belonging to different beams occurs inside that channel, it can be made with one or more restrictions. In those restrictions the beams have increased density, which helps increasing additionally the probability of interaction of the particles belonging to those beams.

One more invention of the suggested group, in which the suggested device for changing the movement direction of a beam of accelerated charged particles is used, refers to the device for obtaining the magnetic field created by the current of accelerated charged particles.

The known cyclic accelerators, some of which were mentioned above, include a closed tract along which charged particles are moving. The electrical current corresponding to their movement generates a magnetic field, the field lines of which pass through the closed contour of the afore-mentioned tract. Hence, cyclic accelerators are capable of performing the function of means for magnetic field generation. However, utilization of such accelerators for magnetic field generation, as those mentioned above, in particular ([2], v. 5, p. 246-253), which is the closest one to the suggested invention, is irrational due to their complexity. Such accelerators themselves contain means for generation of magnetic fields required to form the trajectory of particles and to focus the beam.

The suggested invention is aimed at accomplishment of the technical result consisting in obtaining the magnetic field generated by the current of accelerated charged particles without using magnetic means to control the trajectory of the beam of those particles. It is worth mentioning that the simplest wire coil also generates magnetic field when electrical current is passed through it, without use of magnetic means for transportation of charged particles through that coil. However, electrons only can be the charged particles in this instance. Besides, current in the coil stops as soon as it is no longer fed from the source unless the coil is in the conditions where superconductivity might occur. In the means according to the suggested invention, the particles, which current is creating the magnetic field, may not only have a different nature than electrons but the other sign of the charge as well. Besides, this current (and, consequently, the magnetic field generated by it) may be maintained in the suggested means for a rather long period of time without injection thereto of new particles and at normal temperature, without use of the superconductivity phenomenon.

The suggested device for obtaining the magnetic field generated by the current of accelerated charged particles, same as the said closest thereto one, contains a closed tract for movement of charged particles along it and an injector for injection of the said charged particles in that tract.

To accomplish the said technical result, in the suggested device, in contrast to the closest known one, the said tract is made as a device for changing the movement direction of a beam of accelerated charged particles containing a bent channel for transportation of accelerated charged particles, the wall of which is made of the material capable of electrization. The said channel is made with its longitudinal axis having the shape of a smooth line, the least radius R of curvature of which is related to the highest energy E and the charge Q of the beam of particles, for operation with which this means for obtaining magnetic field is designed for, by the following correlation including also the least thickness d of the channel wall, electrical strength $U_{es}$ of the channel wall material and the longest distance h between two points of the inner surface of the channel, which are located in the channel cross-section on the same normal to the said surface:

$$E/Q<RdU_{es}/h. \quad (7)$$

At that, the channel is made closed and the injector is installed so as to allow injection of accelerated charged particles into the channel on the side facing the centre of curvature of its longitudinal axis.

In the suggested device, the said channel may be made, in particular, with its longitudinal axis representing a closed contour like a smooth flat convex line.

It may be also made with its longitudinal axis taking the form of a cylindrical spiral, which ends are connected one to the other.

In the second of those cases, the efficiency of the suggested device is higher. In contrast to the first case when the suggested device is similar to a single wire loop with electric current, in the second case it has several loops and can be compared with a solenoid.

The channel of the suggested device can be made with its longitudinal axis like a closed spiral wound round a torus. In this instance, the suggested device can be used to obtain toroidal magnetic field in the tokamak installation.

In any of the above-mentioned cases of make, the channel of the suggested device for obtaining magnetic field can be equipped with means for acceleration of the movement of charged particles of the beam injected into the channel. Acceleration may be done, for instance, with the help of electrostatic acceleration sections made as electrodes of opposite polarity arranged in pairs along the channel. At that, in each pair the first electrode in the direction of particles' movement should be the electrode having an opposite polarity than that of the charge of particles used.

It is worth mentioning that in the above source of undulator electromagnetic radiation, linear accelerator, which have an open channel, also in the cyclic accelerator, collider, means for obtaining magnetic field, in which the channel is closed, one can regard, as the suggested device for changing the movement direction of a beam of charged particles, both the channel in general and any part of it that has a curvature since it possesses all features of such device given in its description.

Prior to further description of the suggested inventions, we would draw the attention to that the design of the described devices and the process of their operation should provide for, same as the known devices of similar purpose, the possibility of charged particles' movement in deep vacuum. To this end, the inner space of the channel in any of the suggested devices should have a tight connection with the equipment for creation of vacuum. Realization of this condition can be achieved using the known means of traditional make. Therefore, their presence, design and use are not discussed further on together with the devices according to the suggested inventions.

Figure 2:
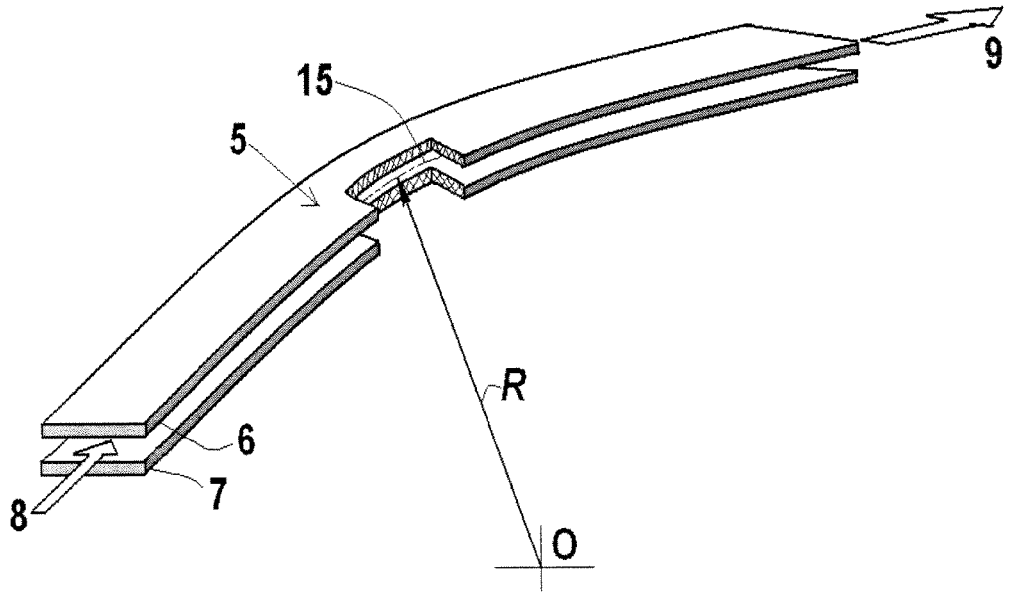
Figure 3A:
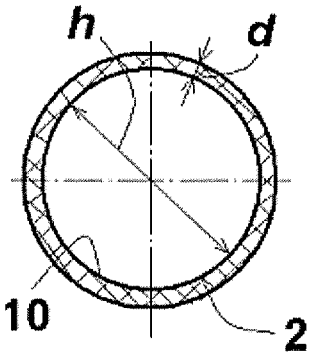
Figure 3B:
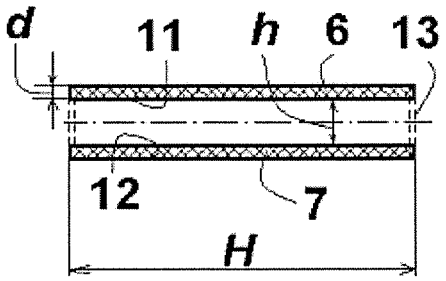
Figure 4:
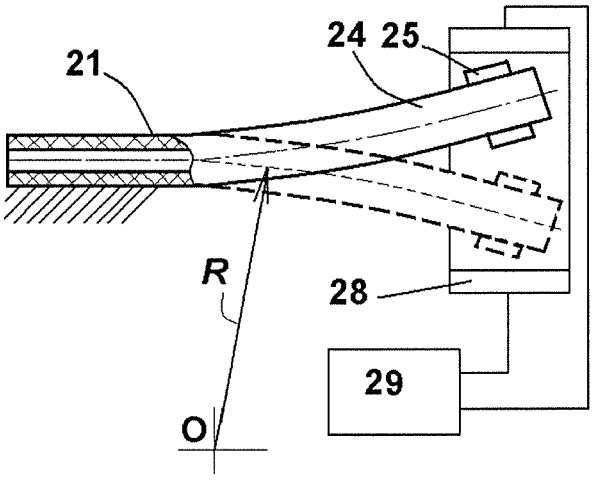
Figure 6:
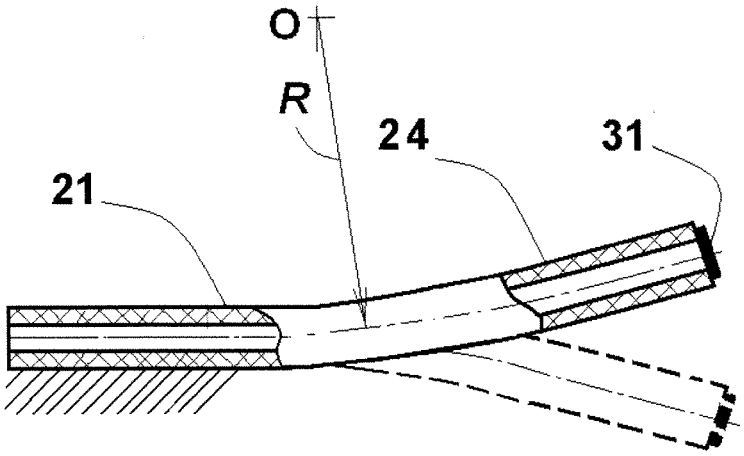
Figure 7:
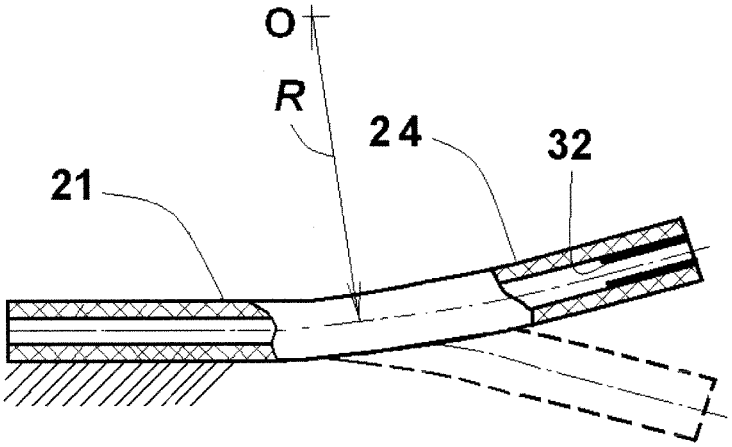
Figure 8:
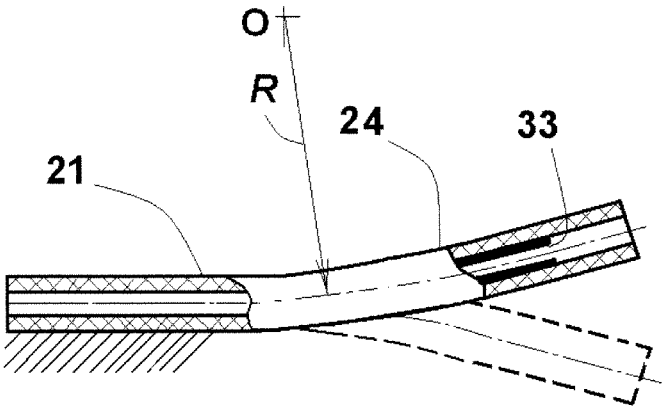
Figure 9:
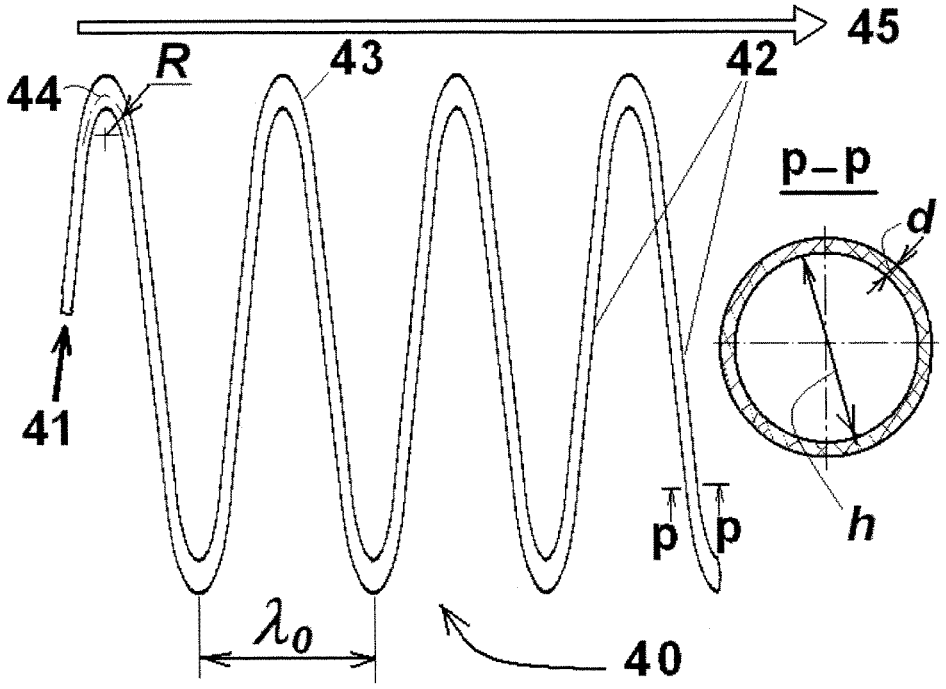
Figure 10:
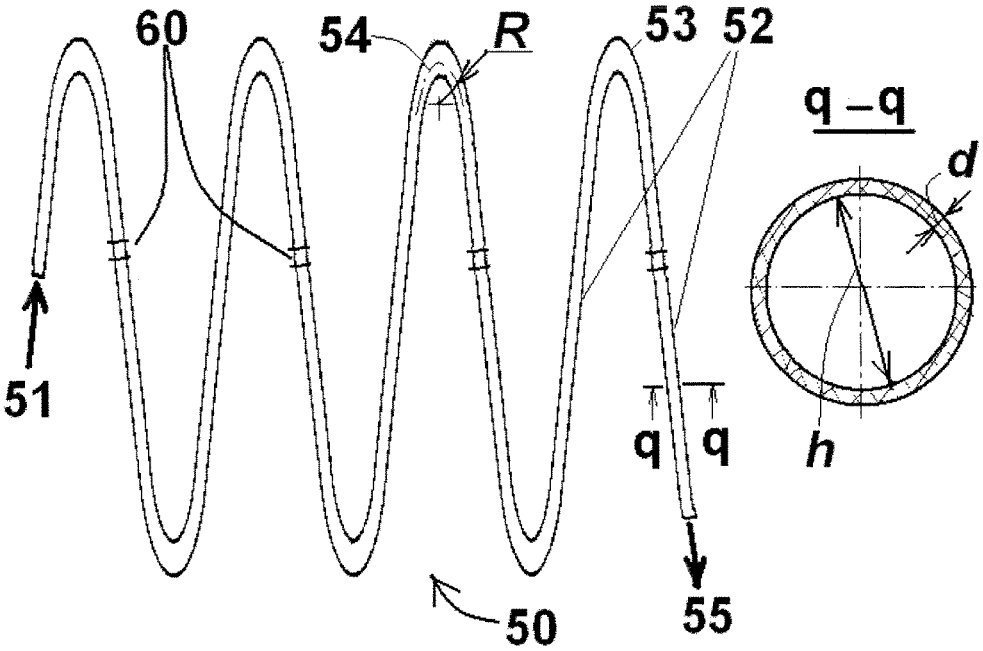
Figure 11:
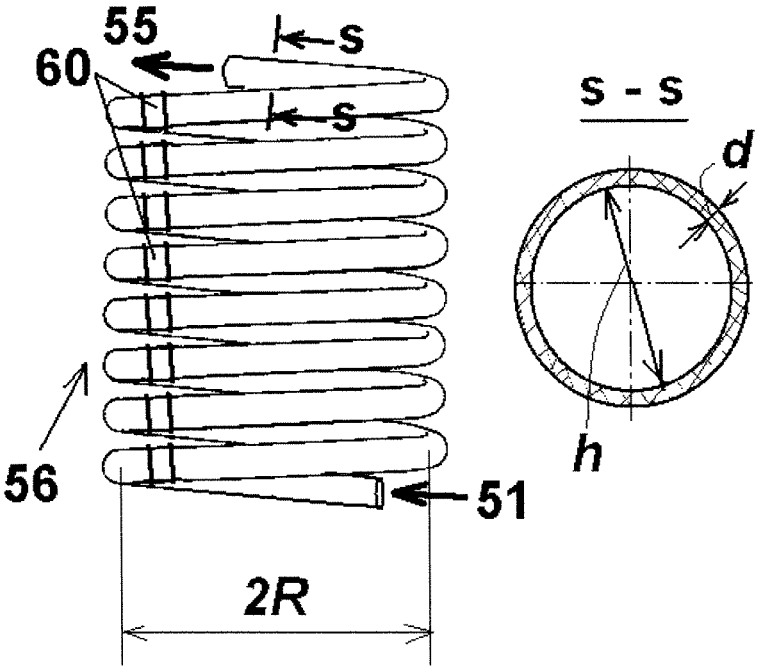
Figure 12:
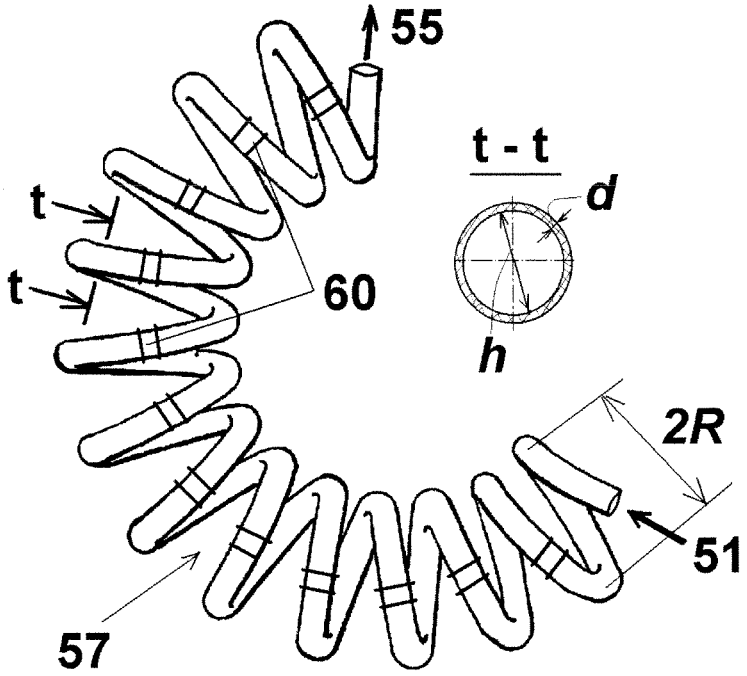
Figure 13:
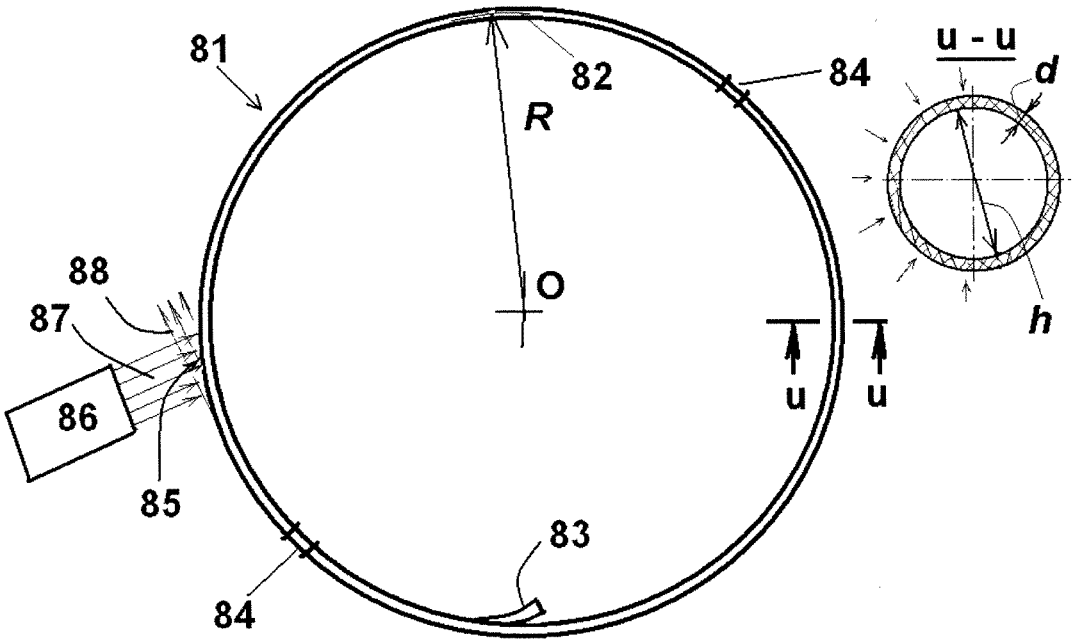
Figure 14:
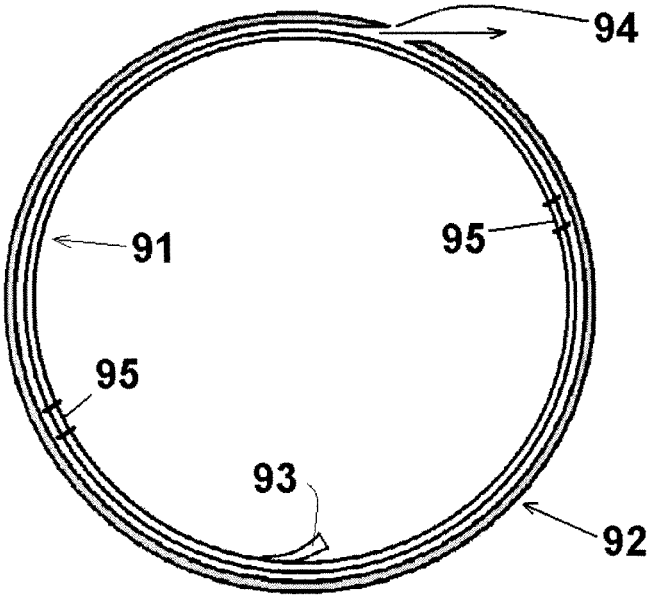
Figure 16:
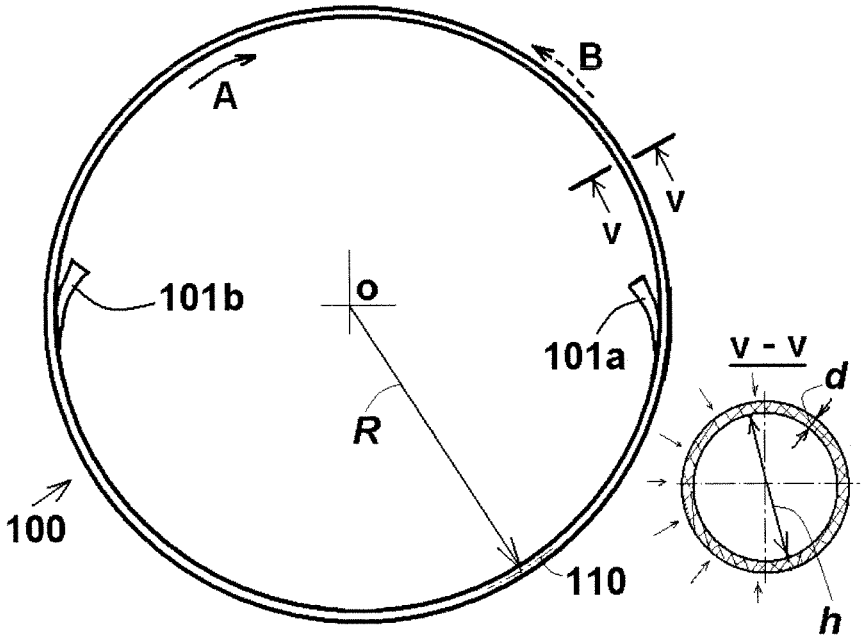
Figure 17:
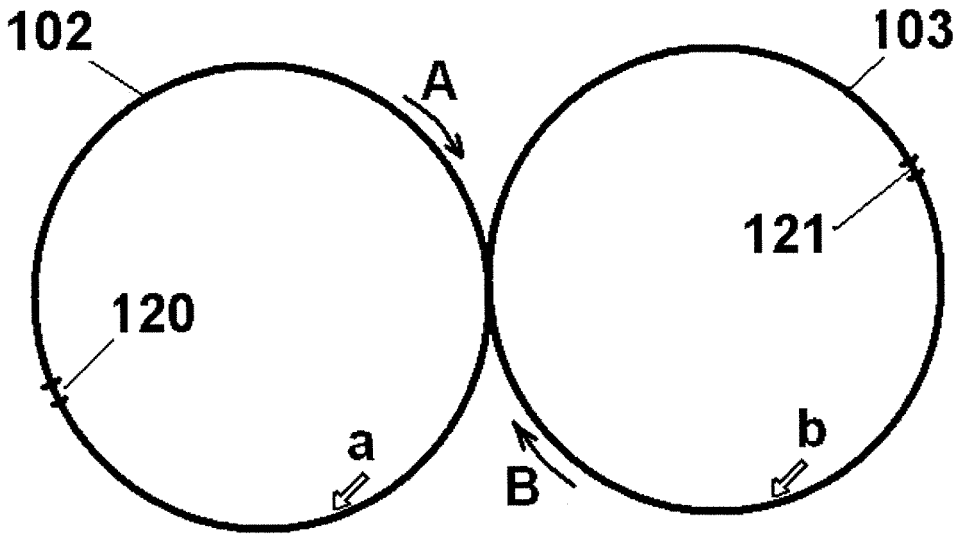
Figure 18:
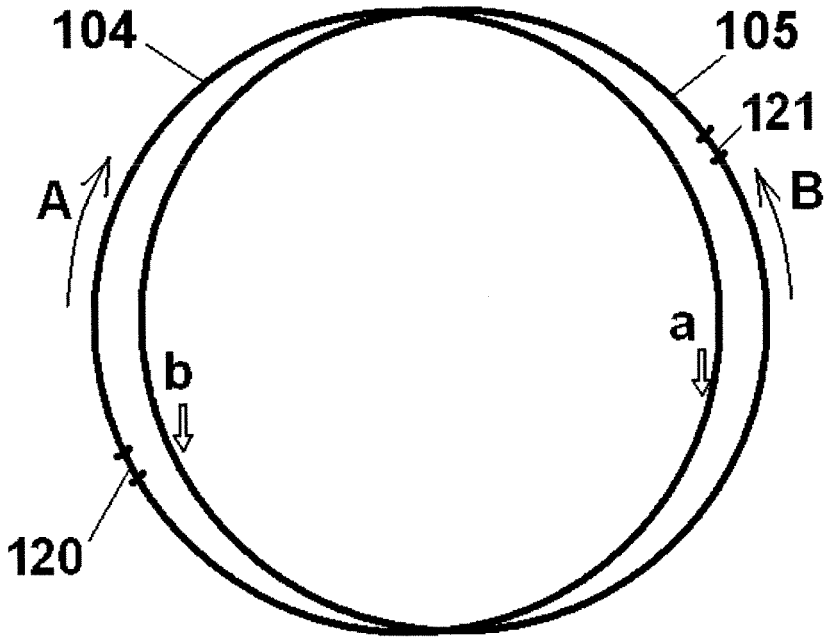
Figure 19:
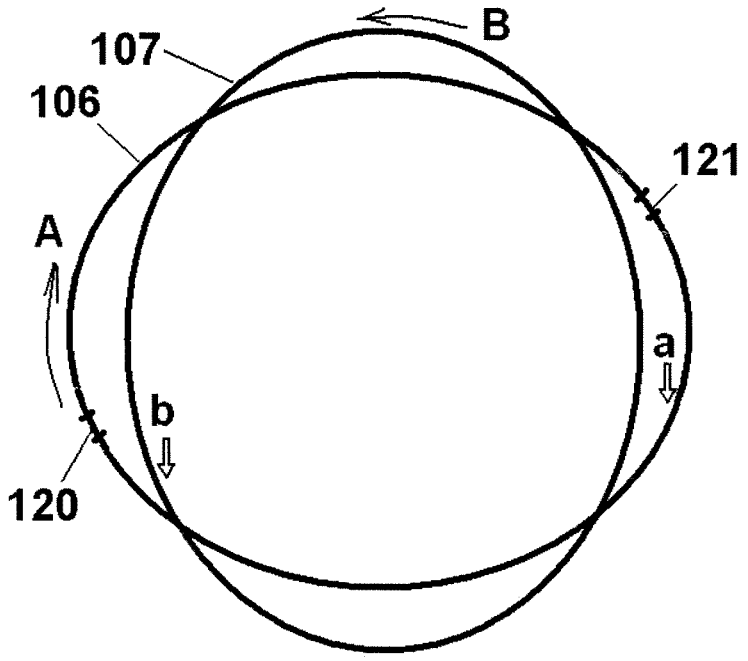
Figure 20:
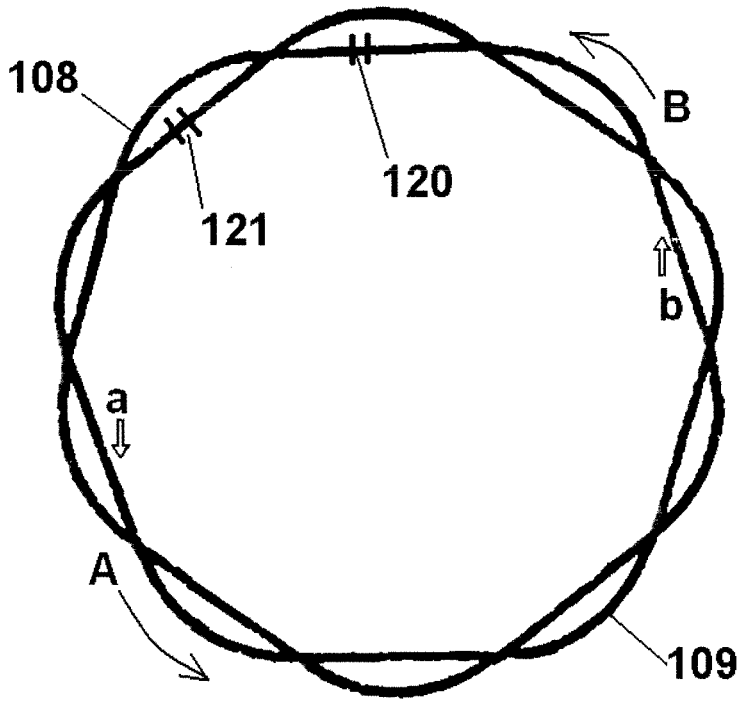
Figure 21:
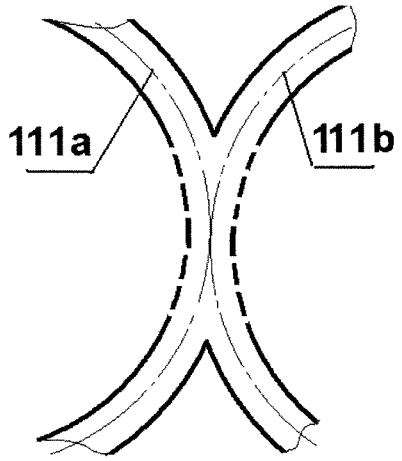
Figure 22:
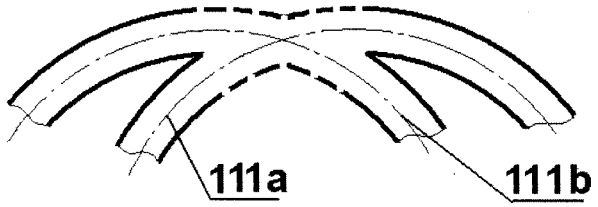
Figure 23:
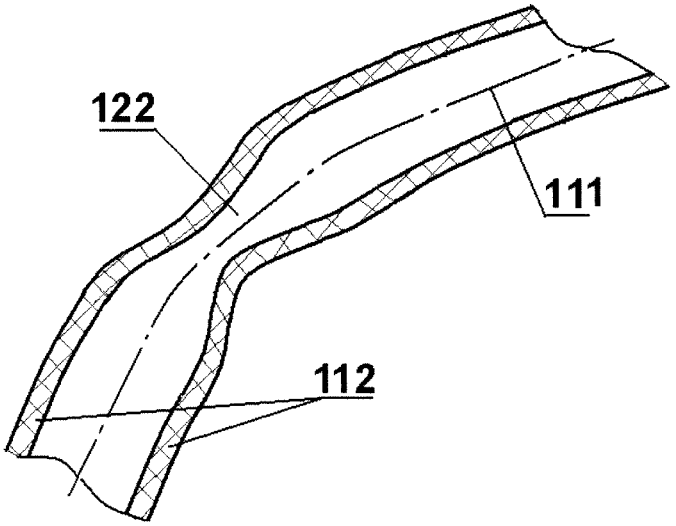
Figure 24:
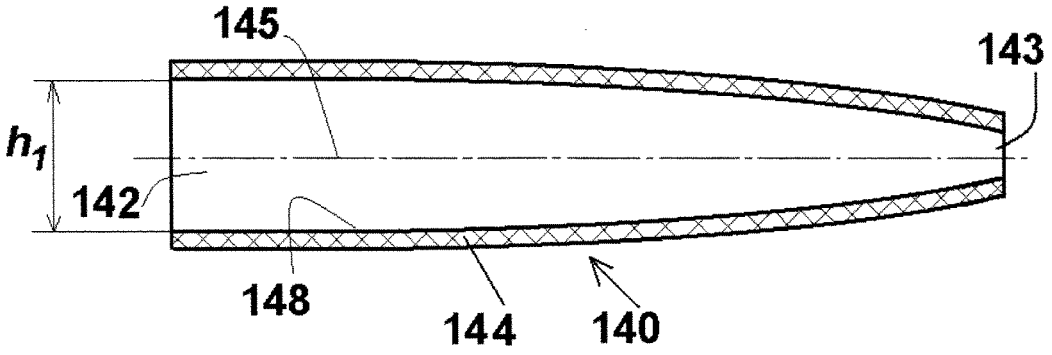
Figure 25:
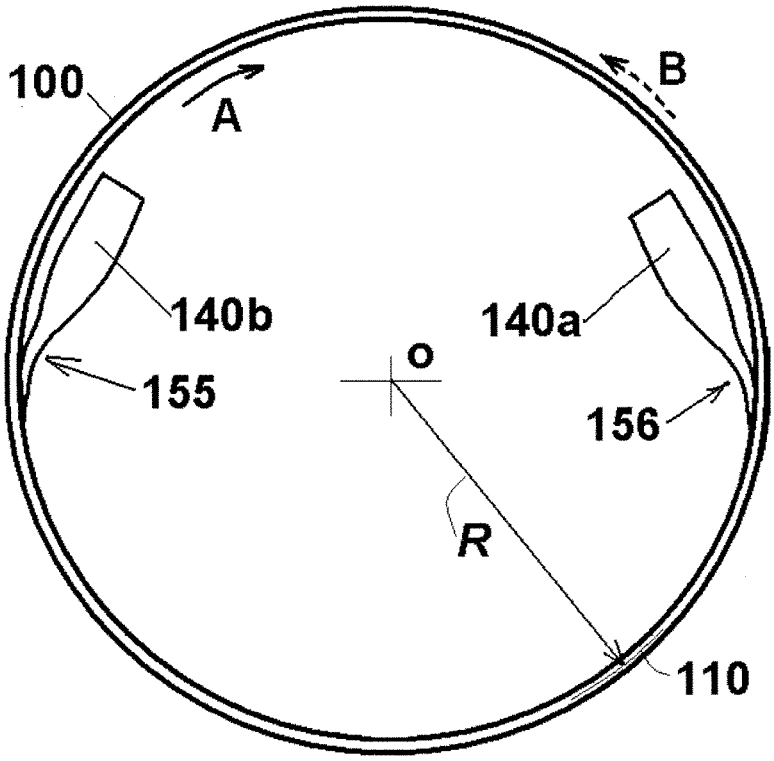
Figure 26:
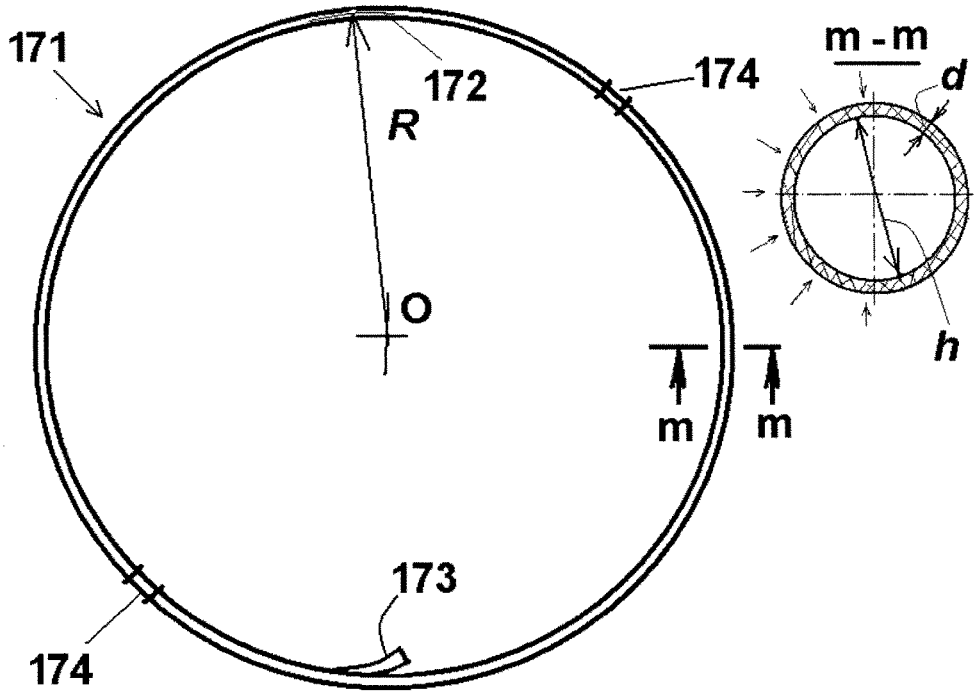
Figure 28:
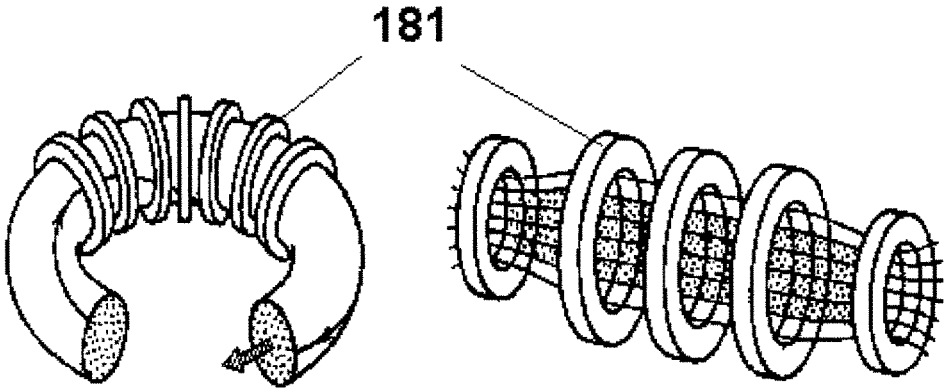
Figure 29:
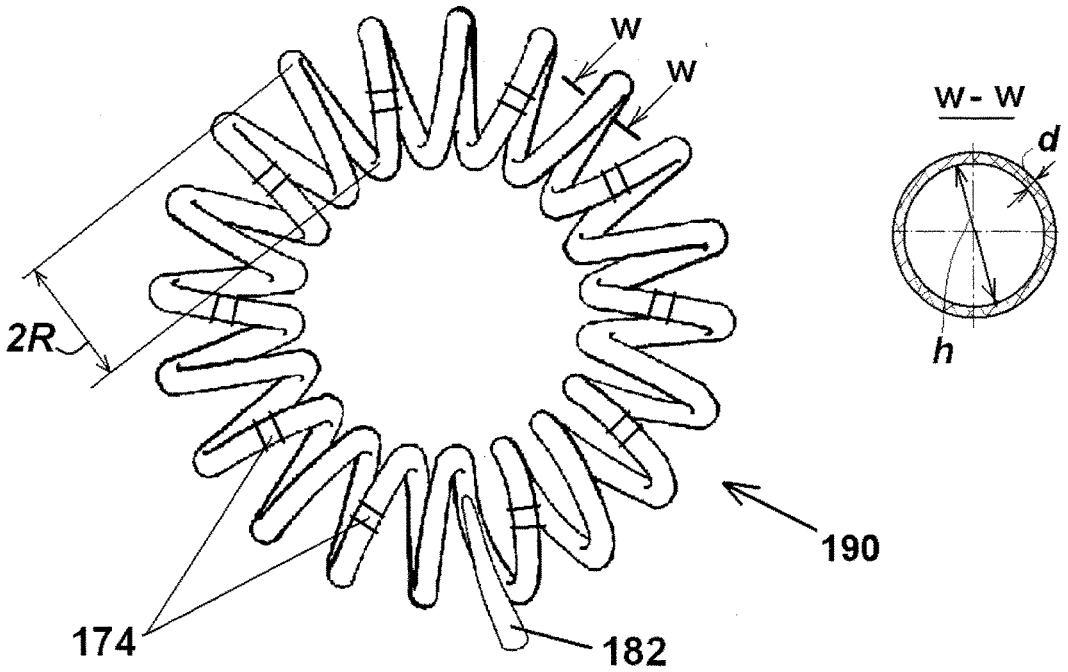

The suggested inventions are illustrated with drawings showing:

FIG. 1—the suggested device for changing the movement direction of a beam of accelerated charged particles, the channel wall of which has a round cross-section;

FIG. 2—the suggested device for changing the movement direction of a beam of accelerated charged particles, the inner surface of the wall of which is formed by two planar surfaces;

FIG. 3A and FIG. 3B—cross-sections of the channels shown on FIG. 1 and FIG. 2;

FIG. 4, 5—control of beam scanning with the help of the suggested device for changing the movement direction of a beam of accelerated charged particles, in which the channel is made flexible;

FIGS. 6-8 the suggested device for changing the movement direction of a beam of accelerated charged particles with an x-ray target closing the channel outlet hole or representing coatings of a part of the inner surface of the channel wall;

FIG. 9—the suggested source of undulator electromagnetic radiation;

FIGS. 10-12—specific cases of make of the suggested linear accelerator of charged particles;

FIG. 13—the suggested cyclic accelerator of charged particles;

FIG. 14, 15—specific cases of make of the suggested cyclic accelerator of charged particles used as a source of synchrotron electromagnetic radiation;

FIG. 16—the suggested collider with a single ring-shaped channel;

FIG. 17—a schematic sketch of the suggested collider with two ring-shaped channels contacting each other with longitudinal axial lines;

FIGS. 18-20—schematic sketches of the suggested collider with two ring-shaped channels crossing each other with longitudinal axial lines at different shapes of longitudinal lines;

FIGS. 21 and 22, correspondingly, the points of contact and crossing of the longitudinal axial lines of the two ring-shaped channels of the suggested collider;

FIG. 23—the restriction that may be made in the collider according to FIG. 16 with a single ring-shaped channel;

FIG. 24—the guiding structure that can be used for injection of beams;

FIG. 25—use of the guiding structure in the collider according to FIG. 16;

FIG. 26, 27—specific cases of make of the means for obtaining magnetic field generated by the current of accelerated charged particles, where the longitudinal axial line of the channel represents, respectively, one flat closed contour and a cylindrical spiral which ends are connected one to the other;

FIG. 28—a schematic sketch of use of magnetic fields in the known tokamak and probkotron installations;

FIG. 29—make of the suggested device for obtaining magnetic field generated by the current of accelerated charged particles, designed for obtaining toroidal magnetic field in the tokamak installation.

Figure 5:
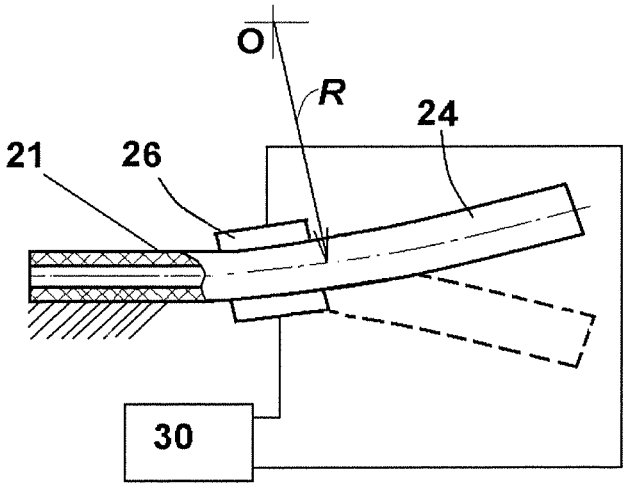

The suggested device for changing the movement direction of a beam of accelerated charged particles contains a bent channel (items 1 on FIGS. 1 and 5 on FIG. 2; O and R, correspondingly, are the centre and radius of curvature of longitudinal axial lines 14 and 15) for transportation of the said particles. Channel 1 of the device according to FIG. 1 is made as a tube with wall 2, while channel 5 of the device according to FIG. 2 has a wall containing two bent bands 6, 7. FIG. 3A and FIG. 3B show, correspondingly, the cross-sections of the channels according to FIG. 1 and FIG. 2. The inner surface of the wall of the channel according to FIG. 1 has the circumferential cross-section 10. The inner surface of the wall of the channel according to FIG. 2 is formed be two planar surface and its cross-section looks like segments 11, 12 of two parallel straight lines. Two parts 6, 7 of the wall of the channel according to FIG. 2 may be connected with lateral walls or supporting elements 13 shown on FIG. 3B with dotted lines. Width H of the channel in this instance is at least by order greater than distance h between parts 6, 7 of the wall (or the same between segments 11 and 12). The aspect ratio of the channel (that is the ratio of its length to the largest linear dimension of its cross-section) in both cases described and other possible cases of its make is presumably large (10–100) and over as is typically the case in devices for channeling of charged particles.

Radius R of curvature of the longitudinal axial line of the channel (items 14 on FIG. 1 and 15 on FIG. 2 where this line goes along the channel in the middle between the said planar surfaces) should be limited on the bottom depending on the highest energy E and the charge Q of the particles, for operation with which this device is designated. The condition expressing this restriction looks like in equation:

$$E/Q<RdU_{es}/h, \qquad (2^*)$$

which also includes electrical strength $U_{es}$ of the channel wall material, the least density d of its wall and the longest distance h between two points of the inner surface of the channel, which are located in the channel cross-section on the same normal to the said surface.

Value h in the equation defined as described above for the device with the channel according to FIG. 1 is the diameter of the inner surface of wall 2 of the channel in the cross-section (or, which is the same, is the diameter of the channel bore), see FIG. 3A. For the device with the channel according to FIG. 2, value h is the distance between the planar surfaces forming the wall of the channel including parts 6 and 7, that is the distance between parallel segments 11 and 12 (see FIG. 1, FIG. 3B). In both cases, value h is the distance between the two most distant between themselves points of the cross-section of the inner surface of the channel wall, located on the same normal to it. On FIG. 3A any diameter is such normal while on FIG. 3B it is any perpendicular to segments 11, 12. The curve of the channel illustrated on FIG. 2 takes place round the axis that is parallel to segments 11, 12 on FIG. 3B. The specific cases of channel make shown on FIGS. 1, 2, and 3 do not exhaust all possibilities; other shapes of cross-section are acceptable as well at which value h may be determined as described above, for instance, elliptical. The two shapes discussed above are the most manufacturable.

Geometric parameters R, h, and d of the channel may vary along the channel length. In the inequation above, R and d mean their least values while h is the highest value that is they are so that this inequation is knowingly fulfilled in any place of the channel along its length. Similarly, the device design should take into account the charge of particles and the maximal value of their energy at which the device will be operated. During operation of the already made device and realization of the suggested method with its help, its parameters depending on the structural geometry (R, d, h) and properties of the channel wall material ($U_{es}$) determine the permissible values of the mode of operation features of the method (E and Q).

The material of the walls of channels 1, 5 should be capable of electrization by the charge of the same sign as the particles of the initial beam. Suitable materials are, in particular, boronsilicate and quartz glass, ceramics, polymers, materials possessing the features of electrets. For such readily available material as glass, electrical strength $U_{es}$ may reach values of the order of $10^8$ V/m (Reference Book on Electrical Engineering Materials. Editors Yu. V. Koritsky, V. V. Pasynkov, B. M. Tareev. Volume 2, p. 207, FIG. 22-11. Moscow, Energoatomizdat, 1987 [11]). Electrization of the inner surface of the channel wall occurs as the device is started and is maintained in the process of operation thanks to that surface recharging (replacement of the few escaping charged with new charges received from the beam being transported). Electrization may also be achieved through pre-charging of the surface, in particular, through utilization of materials possessing electret properties for making the channel wall (see monograph "Electrets", Editor G. Sessler, Moscow, Publishing House "Mir", 1983 [19], p. 32-54, where various methods of charging are described).

Presence on the channel walls of the said charges having the same sign as the particles of the beam injected into the channel, subject to observance of inequation (2*) above (which corresponds to conditions (1) and (2)) provides the possibility of injecting the beam into the channel and its transportation along the channel without substantial losses thanks to the absence of contact with the wall, and without locking the channel. The said also applies to the devices according to all other suggested inventions comprising the suggested device for changing the movement direction of a beam of accelerated charged particles.

The channel of the suggested device can be made both unclosed (and having in this instance the inlet and outlet butt-ends with the inlet and outlet holes, respectively), and closed (which can be regarded as the channel in which the input and outlet butt-ends are united). The angle of deflection of the beam by the suggested device corresponds to the angle between tangent lines to the longitudinal axial line in the beginning and at the end of the channel part, for which the angle of deflection of the beam is determined. The closed make of the suggested channel is discussed in the description of the suggested below cyclic accelerator, collider, and means for obtaining magnetic field. Injection of the beam of charged particles into the closed channel is performed with the help of injector smoothly coupled with the channel rather than through the inlet butt end hole.

On FIG. 1 and FIG. 2 the channel is non-closed and has the inlet and the outlet. The directions of the incoming and outgoing beams are designated respectively by pairs of arrows 3 and 4, 8 and 9. The angle of beam deflection during its movement in the channel is practically unlimited (it can be 360° and over).

EXAMPLE 1

The suggested device may be realized and with its help the suggested method may be realized at the following values of parameters: the radius of curvature of the channel axial line R=30 cm, the diameter of the round cross-section of the channel bore h=3 mm, channel wall thickness d=3 mm, $U_{es}=10^8$ V/m (for the channel wall made of glass). In this instance, the electron beam spreads through the channel without noticeable losses of intensity at energy E up to 1 MeV, even if the channel is made as a spiral having several coils. Inequation (2*) is fulfilled ample:

$$E/Q<(1/30)RdU_{es}/h.$$

The channel of the suggested device for changing the movement direction of a beam of charged particles can be made flexible, at least, in some part of its length. In this instance, its part adjacent to the inlet butt-end should be rigidly fixed while the remaining part should be flexible.

Besides, the device may be equipped with a means for controlled bending of the flexible part of the channel.

In the cases shown on FIG. 4 and FIG. 5, the left part 21 of the channel is rigidly fixed while the right part 24 is free and can oscillate under the action of electromagnetic (FIG. 4) or piezoelectric (FIG. 5) forces. To this end, on the right part 24 of the channel according to FIG. 4 or FIG. 5, correspondingly, a pair of ferromagnetic elements 25 or piezoelectric bending elements 26 (or two such pairs mounted orthogonally one relative to the other) are fixed. The ferromagnetic elements of the pair according to FIG. 4 are placed between the poles of electromagnetic system 28. The latter is connected to source 29 of control signals while piezoelectric elements 26 on FIG. 5—to source 30 of control signals. Such make allows beam scanning in one direction or two mutually orthogonal directions.

The controlled bending means according to FIG. 4, 5 should be made with regard to the above limitation and should prevent channel bending at a too small radius R. The channel of the suggested device can be made flexible even if it is made of glass at small outer cross-sectional dimension.

The flexible device for changing the movement direction of a beam of charged particles, for instance, electrons (not necessarily equipped with the beam scanning means discussed above) can be used in the therapy of malignant growths or other pathologies also in stereotaxic radiation surgery for transportation of charged particles to the target area including directly into the nidus. Particles can be injected both through the surface of the patient body and with the help of a needle-type probe that may be the end of the flexible part of the channel. Thanks to the flexibility of the channel in general or its part, it can be introduced into the cavities of the patient body through natural holes.

In the channel of the suggested device, both when it is made fixed and when it is made flexible (in the latter case—both when it has and when it does not have means for controlled bending), there may be a target for excitation of characteristic x-ray radiation in its material. The target is placed in the channel part adjacent to its outlet butt-end. If there is a target, then electrons should be used as accelerated charged particles.

FIGS. 6-8 show several cases of channel make with the target without using the means for controlled bending, but in each of those cases such means can be used, for instance, any of the means shown on FIGS. 4 and 5.

On FIG. 6 the target is placed in the channel outlet butt-end. Such target should be thin enough to play the role similar to the transmission anode in the x-ray tube. In this case, the impact on nidus can be rendered by x-rays.

If the inner surface of the wall of part 24 of the channel close to the outlet butt-end is covered with target material 32, then the suggested device also becomes a source of x-rays excited by the action rendered by electrons of the beam transported through the channel on the target material.

When the channel wall is covered with target material 33 in the part 24 that is not directly neighboring the outlet butt-end but is somewhat spaced from it (FIG. 8), in the channel outlet part that is free of coating (from the point of coating up to the outlet butt-end) x-rays propagate with multiple total external reflection. In this case, a 'pencil' x-ray beam can be obtained that has a quite small cross-sectional dimension (up to tens nanometers), which is determined by the channel cross-sectional dimension. This dimension can be less than the dimension of the irradiating spot on the anode of the conventional micro-focus x-ray tube, because the latter, even with a small size of the focal electron spot on the anode, is determined by the length of the free run of electrons in the anode material, which is of the order of 1 micron.

We would mention that with regard to the above description, the non-fixed part 24 should not be necessarily made flexible along its whole length. For instance, it can be rigid on the side adjacent to the outlet butt-end (right according to FIGS. 4-8), and flexible on the side adjacent to the fixed part 21 of the channel (left according to FIGS. 4-8).

The make of the suggested device that is similar to that described above can be also used in medical radiation diagnostics, in particular, to obtain a phase-contrast image of an object containing elements that have small atomic number, for example, in mammography and diagnosis of diseases of other organs that have soft tissues. In such cases, together with the suggested device, a means for transportation to the secondary radiation detector is used. In this instance, it is possible to use both charged particles, for example, electrons, and x-ray radiation that is converted into the electron beam acting on the target material in the above specific cases of make of the suggested device.

When schemes like those given on FIG. 4 and FIG. 5 are used, the suggested device can be used as part of an x-ray tube or the optical system of an electronic microscope for focal spot scanning. When the suggested device is used as part of an electronic microscope, the latter can be operated both in the scanning mode and in the 'transmission' mode. Engineering solutions similar to those described above can be also applied in proton and ion microscopes. It is also possible to use the suggested device with beam scanning to realize the function of an electronic micro probe with surface scanning.

When the suggested device is made with a fixed channel, including the case when inside it there is a target for excitation of x-rays in its material, its bends may be made in different directions, both in one plane and spatially. This creates various possibilities for using the suggested device as part of other devices, which are also included in the suggested group of inventions. Inter alias, such use of the device is possible when the useful function is performed by the beam inside the channel that has different movement directions in different parts of the channel rather than the beam going out from the channel.

Such use takes place, in particular, in the suggested source of undulator electromagnetic radiation. It is known [2], that undulator radiation is generated in a device forming a serpentine trajectory of the beam of charged particles and concurrently focusing the beam whilst it moves along that trajectory. In the suggested source of undulator electromagnetic radiation, such functions are combined in the device for changing the movement direction of accelerated charged particles, which has the design as described above the only difference being that the longitudinal axial line of the channel is shaped correspondingly to the shape of the particles' trajectory that is necessary for generation of undulator radiation. This device contains (FIG. 9) bent channel 40, the wall of which is made of the material capable of electrization. Channel 40 is made with longitudinal axis 44 having the shape of a smooth line, its least radius R of curvature being related to the highest energy E and the charge Q of the particles of the beam, for operation with which this source of undulator electromagnetic radiation is designed for, by the following correlation including also the least thickness d of the channel wall, electric strength $U_{es}$ of the channel wall material, and the longest distance h between two points on the inner surface of the channel, which are located in the channel cross-section on the same normal to the said surface:

$$E/Q<RdU_{es}/h. \quad (3^*)$$

The geometric parameters of the channel cross-section are illustrated by the image of the round cross-section given on FIG. 9. For the case when the inner surface of the channel wall is formed by two planar surfaces, one can use FIG. 3B and explanations in the text pertaining to it.

Bent channel 40 contains rectilinear or slightly curved segments 42 and segments 43 for smooth joining of sections 42. Hence, in general, it has a serpentine or zigzag shape with rounded corners.

Channel 40, in addition to forming a bent trajectory of particles, provides concurrently focusing of injected therein beam 41 of accelerated charged particles. Fulfillment of the above inequation (3*) corresponding to condition (3) is also necessary to ensure transportation of the beam of charged particles through that channel without losses.

Since in order to ensure the serpentine or zigzag shape of the beam in the suggested source of undulator radiation it is enough to have a channel of a respective shape, such source is significantly simpler than the traditional undulator including also a complex magnetic system. Most of radiation is generated in the said, having the greatest curvature, segments 43 for smooth joining rectilinear or having smaller curvature segments 42.

EXAMPLE 2

At bent repetition period of bent channel 40 equal to $\lambda_0$=5 cm (see FIG. 9) and energy of particles (electrons) E=500 MeV, the radiation wavelength on the main frequency in the forward direction (shown on that figure by arrow 45) will be approximately equal to $\lambda=\lambda_0\gamma^{-2}$, where $\gamma$ is the relativistic factor. In this instance, electromagnetic radiation takes place with the wavelength of the order of several tens of nanometers, i.e. in the ultraviolet range of spectrum.

At $U_{es}=10^8$ V/m (for glass) and geometric parameters of the channel: R=1.1 cm, d=0.9 cm, h=4 micron, condition (3*) is fulfilled with five-fold "reserve".

The suggested linear accelerator of charged particles, in one of specific cases of its make, has the design (FIG. 10), similar to the described above source of undulator electromagnetic radiation, the difference being the inclusion of means for acceleration of the movement of charged particles. The traditional for linear accelerators accelerating tract with means for focusing of the beam of charged particles in the course of their movement through that tract is made as a device for changing the movement direction of a beam of charged particles. It contains bent channel 50 for transportation of the said particles, the wall of which is made of the material capable of electrization. The channel is made with longitudinal axis 54 having the shape of a smooth line, the least radius R of curvature of which is related to highest energy E and the charge Q of the particles of the beam, for operation with which this linear accelerator is designed for, by the following correlation including also the least thickness d of the channel wall, electric strength $U_{es}$ of the channel wall material, and the longest distance h between two points on the inner surface of the channel located in the channel cross-section on the same normal to the said surface:

$$E/Q<RdU_{es}/h. \quad (4^*)$$

The geometric parameters of the cross-section of channel 50 are illustrated by the image of round cross-section given on FIG. 10. For the case when the inner surface of the channel wall is formed by two planar surfaces, one can use FIG. 3B and the explanations in the text pertaining to it.

Bent channel 50 contains rectilinear or having small curvature segments 52 and segments 53 for smooth joining of segments 52. Hence, in general it has a serpentine or zigzag shape with rounded corners. Radius R of curvature of longitudinal axial line 54 of the channel, which is minimal in segments 53, should satisfy the above inequation (4*) corresponding to condition (4).

Channel 50, in addition to forming the bent trajectory of particles, provides concurrently the focusing of injected therein beam 51 of preliminarily accelerated charged particles. Fulfillment of the above condition is necessary to ensure transportation of the beam of charged particles through that channel without losses. Increase of the speed of charged particles' movement along this channel may be implemented by known methods, for instance, with the help of high-frequency fields; see also monograph [13], p. 6-83, 120-143. But in this case, electrostatic means made as pairs of electrodes 60 of different polarity arranged along channel 50 of the acceleration tract are simpler and, thus, preferable. In each of such pairs, the first electrode in the direction of particles' movement is the electrode, which polarity is opposite to the sign of charge of particles in the accelerated beam.

The accelerator containing the channel similar to channel 50 but without bents could be a full analogue of the known linear accelerators [13]. However, the known linear accelerators have a large length. Thanks to that the channel of the suggested accelerator does not need any additional means to provide beam transportation through the channel, including when it has bents, the accelerator dimensions can be considerably diminished. The accelerator remains linear in spite of existence of bents of the accelerating tract channel because the charged particles' movement trajectories in it are not closed. Initial beam 51 enters channel 50, is accelerated in it by means 60 and, having experienced several turns, leaves the channel as beam 55 of particles having a higher energy than particles of the initial beam.

Still more compact than that shown on FIG. 10 is the accelerator with channel 56 of the accelerating tract having the shape of a cylindrical spiral (FIG. 11). The accelerator with channel 57 of the accelerating tract made as a spiral with its coils arranged over torus surface (FIG. 12) may have even smaller dimensions. The geometric parameters of the cross-section of channels 56, 57 are illustrated by the images of the round cross section given on FIG. 11 and FIG. 12, correspondingly. For the case, when the inner surface of the channel wall is formed by two planar surfaces, one can use FIG. 3B and explanations in the text pertaining to it. FIG. 11 and FIG. 12 also show radii R of curvature of longitudinal axis of channels 56, 57.

EXAMPLE 3

Modern technology easily allows accelerating protons in a 10 cm long segment by 2.5 MeV. Even if in the accelerator according to FIG. 11 1 pair of accelerating electrodes 60 is placed on each coil of the spiral, then at radius R of the spiral axial line of bent channel 56 equal to 50 cm and 10 coils of the spiral, it is possible to achieve energy increase by 25 MeV, for instance, if wall thickness d=5 mm and channel diameter h=1 mm (it is assumed that the channel wall is made of glass having electric strength $U_{es}$ equal to $10^8$ V/m). In this instance, inequation (4*) is fulfilled with a large "reserve":

$$E/Q<0{,}1RdU_{es}/h.$$

Such kind of simple accelerator may be of interest in medicine for proton or ion therapy.

Besides the described source of undulator electromagnetic radiation and linear accelerator, the suggested device for changing the movement direction of accelerated charged particles may be also used in the suggested cyclic accelerator of charged particles.

The suggested cyclic accelerator of charged particles contains the traditional for such accelerators closed accelerating chamber with the means for focusing the beam of charged particles in the course of their movement in that chamber, the means for increasing the speed of charged particles' movement, and the injector for injecting the initial beam of preliminarily accelerated charged particles into the said chamber.

The specific feature of the suggested cyclic accelerator is that the said closed accelerating chamber with the means for focusing the beam of charged particles in the course of their movement in that chamber is made as the suggested device for changing the movement direction of the beam of accelerated charged particles. It contains (FIG. 13) bent channel 81 for transportation of the said particles, which wall is made of the material capable of electrization. The channel is made with longitudinal axial line 82 (only a part of it is shown) shaped as a smooth line, the least radius R of curvature of which is correlated to the highest energy E and the charge Q of the particles of the beam, for operation with which the cyclic accelerator is designed, by the following correlation including also the least thickness d of the channel wall, electric strength U of the channel wall material, and the longest distance h between two points on the inner surface of the channel, which are located in the channel cross-section on same normal to the said surface:

$$E/Q<RdU_{es}/h. \quad (5^*)$$

At that, the said channel 81 is made closed like a ring.

The smooth line that is the shape of its longitudinal axis, in the case shown on FIG. 13, is convex while injector 83 is mounted so as to enable injection into the channel of preliminarily accelerated charged particles of the initial beam on the side of the ring formed by that channel, which gives to center O of curvature of its longitudinal axial line 82.

Such arrangement of injector 83 and such shape of longitudinal axis 82 are explained by that in the course of movement along the closed curvilinear trajectories the particles of the beam are "squeezed up" against the peripheral side of the inner surface of the wall of the channel representing the accelerating chamber. For this reason, it is expedient to inject particles of the initial beam into the channel from the opposite side, i.e. from the side of the ring giving on the center of curvature of the longitudinal axial line. This allows reducing the probability that the particles already present therein and making cyclic movement would "escape" from the channel. As for the convex shape of the smooth longitudinal axis of the channel, it is easy to make sure that otherwise, if the condition (5*) is met, the accelerator dimensions would have been considerably larger.

The geometric parameters of the cross-section of channel 81 are illustrated by the image of the round cross-section given on FIG. 13 (for the case when the inner surface of the channel wall is formed by two planar surfaces, one can use FIG. 3B and the explanations in the text pertaining to it). On the cross-section image on FIG. 13, the arrows additionally show the preferable points for injection of the initial beam particles satisfying the above-worded condition: on the side the ring giving on the center of curvature of its longitudinal axial line.

It should be noted that the longitudinal axis, as follows from the above, should be closed and should represent a convex smooth line. However, it should not necessarily be a circumference and may have different curvature in different segments. It is only necessary that the above inequation (5*) corresponding to condition (5) be satisfied at the smallest radius of curvature.

Fulfillment of this inequation is necessary in order to ensure transportation of charged particles along the channel of the closed accelerating chamber without losses and ensure focusing of the beam experiencing additional acceleration in that chamber. Therefore, the ring-shaped channel 81 of the closed accelerating chamber performs both the function of the means providing cycling movement of the beam of particles and the function of the means for focusing the beam in the course of that movement.

Channel 81 of the closed accelerating chamber is equipped with means for increasing the speed of movement of charged particles along that channel. Acceleration of particles in channel 81 can be done by the known methods, for example, with the help of high-frequency fields; see also monograph [13], p. 6-63, 120-143. However, electrostatic acceleration can be implemented easier and without losing the realization simplicity inherent in the suggested device. Such acceleration is performed in the accelerating sections taking the form of electrodes of different polarity arranged in pairs along the channel, wherein in each pair, the first electrode in the direction of particles' movement is the electrode having an opposite polarity than that of the charge of particles to be accelerated. Of FIG. 13 presence of such sections is schematically shown as items 84.

So, the suggested cyclic accelerator is a passive device that does not require supply of electricity except for the DC power source to which electrodes 84 should be connected (similarly to electrodes 60 of the linear accelerator discussed above).

For the output of particles of the accelerated beam from channel 81 of the closed accelerating chamber, outlet zone 85 is arranged. To this end, on the outer side of the ring formed by channel 81, there is source 86 of charged particles having the sign corresponding to the sign of the accelerated beam. Source 86 is installed so that beam 87 formed by it would be directed to the said zone 85 on the outer surface of the ring. As a result, neutralization of the charges of opposite sign induced on the outer surface of ring 81 and, consequently, decrease of charge on the inner surface, which field provides bending of the particles' trajectory, takes place. The accelerated particles continuing their tangential movement relative to the initial trajectory bent earlier under the action of charged inner surface of the wall exit the channel straight through its wall in the direction shown with arrows 88 on FIG. 13.

The common feature of the described rotor accelerator and the traditional rotor accelerator is the periodic nature of particles' movement. However, when the suggested accelerator is used, there is no requirement for a complex power-consuming and cumbersome in dimensions magnetic system providing particles' movement along the closed trajectory and their focusing in the channel or for controls of current frequency in that system. The functions of controlling the particles' trajectory and their focusing are performed by channel 81 of the closed accelerating chamber itself.

EXAMPLE 4

Acceleration of particles having a charge equal to the charge of electron to energy E=500 MeV can be achieved at the following geometric parameters: radius $R=2\cdot10^2$ cm (i.e. the outer dimension of the accelerator is 4 m), channel wall thickness d=25 mm, channel diameter h=2 mm (it is assumed that the channel wall is made of glass with electric strength $U_{es}$, equal to $10^8$ V/m). It is known that for medical purposes, proton and ion accelerators with up to 100 MeV energy are required. In this case, it is possible to reduce the ring diameter to 80 cm, so the accelerator is quite compact in size. At that, inequation (5*) is fulfilled with considerable "reserve":

$$E/Q<0,2RdU_{es}/h.$$

The described rotor accelerator can be used as a source of electromagnetic radiation.

EXAMPLE 5

If one uses the ring-shaped channel of the closed accelerating chamber with radius R of axial line equal to 3 m, wall thickness d=10 mm, and inner diameter h of that channel equal to 0.5 mm, then by passing charged particles through such channel one can obtain electromagnetic radiation in a wide range of wavelengths depending on energy E of particles. In case of nonrelativistic velocities of particles, radiation occurs at cyclotron frequencies. For example, if the particles moving in the ring-shaped channel are electrons, then energy losses, i.e. radiation intensity is $I=2e^2V^4/(3R^2C^3)$, where V is the particles' velocity, e is electron charge, C is light velocity. At energy E=50 keV and ratio V/C equal to 0.4, radiation intensity I is of the order of $10^{-3}$ eV/sec. At that, the typical wavelength of the generated electromagnetic radiation has the order of radius R, i.e. 3 m; that is the radiation is in ultrashortwave radio spectrum. For relativistic electrons, energy loss is $I=2e^2V^4\gamma^4/(3R^2C^3)$, where $\gamma=E/(m_0C^2)$ is the relativistic factor. In this case $m_0C^2\approx0.5$ MeV. At E=1 GeV the relativistic factor is $\gamma\approx2\cdot10^3$ and the energy loss for radiation equals to $I=5\cdot10^{11}$ eV/sec. In this case, synchrotron radiation takes place. At that, the typical wavelength has the order of $R/\gamma^3\approx3\cdot10^{-8}$ cm=3 Å. This wavelength corresponds to the photon energy of about 4 keV, i.e. the radiation is in the X-ray spectrum.

The source of synchrotron radiation is shown on FIG. 14. In order to localize the synchrotron radiation output, the closed accelerating chamber formed by channel 91 is enclosed in housing 92 that is impenetrable for synchrotron radiation, in which window 94 (or several such windows) is made for radiation output. Injector 93, with the help of which the initial beam of preliminarily accelerated charged particles is injected in closed channel 91, is placed on the inner side of the ring formed by that channel. The closed accelerating chamber formed by channel 91, same as the chamber shown on FIG. 13, is equipped with electrostatic means 95 for acceleration of particles.

Figure 15:
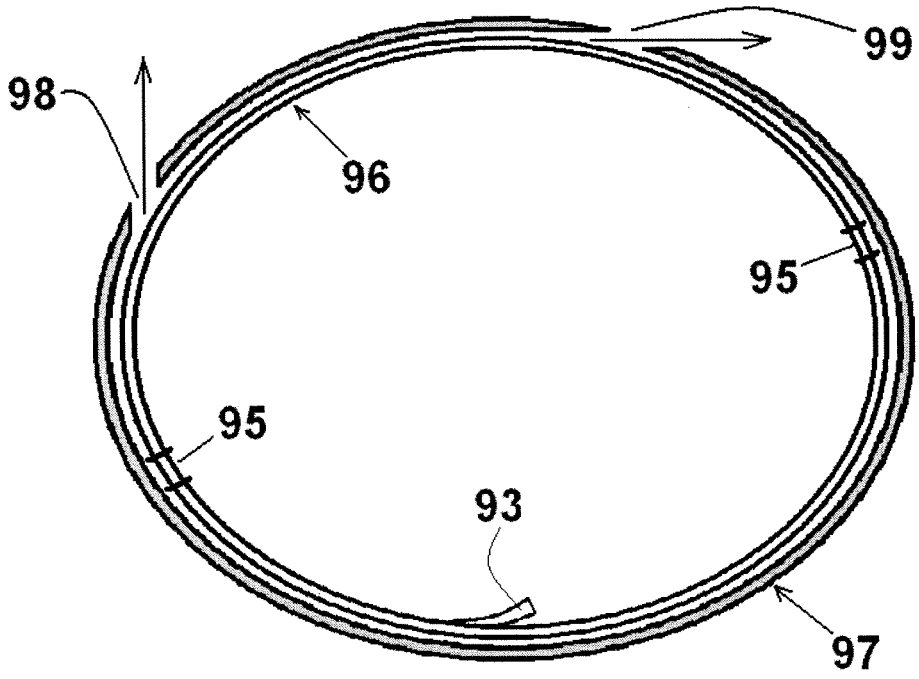

The channel of the closed accelerating chamber of the suggested cyclic accelerator, used as the source of synchrotron radiation, may be made with variable curvature, for instance, it can have an elliptic shape as shown on FIG. 15. This allows obtaining synchrotron radiation at different frequencies. At that, the output windows for synchrotron radiation should be arranged in the places of the housing corresponding to the required curvature of channel 96. FIG. 15 shows two such windows 98, 99 in housing 97 made in the points of the largest and smallest curvature of channel 96 of the closed accelerating chamber. The latter is equipped with electrostatic means 95 for acceleration of particles. Particles are injected into the channel, just as on FIG. 14, with the help of injector 93 installed on the inner side (i.e. on the side giving on the center of curvature) of the ring formed by channel 96.

Another suggested invention is the collider: a unit designed to provide conditions for collisions of beams of accelerated charged particles.

The suggested collider uses the device for changing the movement direction of a beam of accelerated charged particles according to the suggested invention referring to such device, in which, just as in the cyclic accelerator discussed above, the bent channel is closed (and, consequently, its longitudinal axial line is closed). In this instance, as detailed below, the collider may contain one or two such channels. Depending on this, the two beams, which interaction should be provided, move through the same or through different channels. In the latter case, the inner spaces of channels are partially overlap, thanks to which both beams may pass through the part of space that is common for them. For any of the beams and the channel in which it is moving, the correlation should be satisfied between the least radius R of curvature of the longitudinal axis of the channel, the highest energy E and the charge Q of the particles of that beam, the least thickness d of the channel wall, electric strength $U_{es}$ of the channel wall material, and the longest distance h between two points of the inner surface of the channel, which are located in the channel cross-section on the same normal to the said surface:

$$E/Q<RdU_{es}/h. \quad (6^*)$$

Fulfillment of correlation (6*) corresponding to condition (6), the channel wall being made of the material capable of electrization, provides beam movement in the channel without its contact with the wall and without intensity loss.

The suggested collider may contain one closed ring-shaped channel 100 (FIG. 16), or two ring-ling channels 102 and 103 contacting each other with their longitudinal axial lines (FIG. 17), or two ring-shaped channels 104 and 105 (FIG. 18), 106 and 107 (FIG. 19), 108 and 109 (FIG. 20) with their longitudinal axial lines crossing each other. On those figures arrows show propagation in the channels of beams A and B designated for interaction in opposite directions. On FIG. 16 items 101*a* and 101*b* show the means for injection of the initial beams of preliminarily accelerated particles into the channel. This figure also shows a part of longitudinal axial line 110 and radius R of its curvature. On FIGS. 17-20, where colliders are shown schematically, white arrows a and b show the points for mounting the means for injection into the channels of initial beams A and B and the directions of their injection.

Since the beams moving in the channel with a convex axial line are "squeezed up" against the peripheral (more distant from the center of curvature) side of the wall, it is expedient to inject particles into the channel from the opposite side giving on the center of curvature of the longitudinal axis of the channel. On FIG. 16 it is the part of the wall looking towards center O; on FIGS. 17-20 these are the parts of the walls looking towards the centers of respective circumferences, ellipses, regular polygons. This reduced the probability that the particles which are already present in the channel would escape from the channel through the hole in the wall, through which injection is performed. Observance of the condition under discussion is especially expedient in case when one and the same channel is used for counter beams (FIG. 16).

Besides, as one can see from the listed figures, in the cases shown on those figures the longitudinal axis of each of the channel is convex. At that, the longitudinal axis does not have contraflexures (change of sign of curvature) and the beam of particles is always "squeezed up" to the same side of the inner surface of the inner surface of the channel wall. Thanks to this, it is possible to achieve fulfillment of condition (6*) at the smallest outer dimensions of the collider. The geometric parameters of the cross-section of channel 100 according to FIG. 16 are illustrated by the image of the round cross-section given on the same figure. The channels of colliders shown on other figures are made similarly. The channels may also be made so that the inner surface of their walls would be formed by two planar surfaces (such channel, which is not closed, is shown on FIG. 2 and its cross-section—on FIG. 3A). On the cross-section image on FIG. 16, additionally, the arrows show the preferable points of injection of the initial beam particles, which satisfy the condition worded in the paragraph above.

At any of the makes shown on FIG. 16-FIG. 20 the colliders may be used for implementation of interaction of particles in the beams propagating in the same direction ("pursuit" beams). To this end, one of the beams should have a direction that is opposite to the direction shown on FIG. 16-FIG. 20.

In the cases of make shown on FIG. 16-18 the channels have longitudinal axial line in the form of a circumference, and in the cases shown on FIG. 19 and FIG. 20—in the form of an ellipse or convex polygon with smooth joining of neighboring sides, respectively. Compared to the make when the channel axial line has the form of a circumference, the make in the form of an ellipse (FIG. 19) allows obtaining four rather than two crossing channels (i.e. the places where interaction of particles belonging to different beams is possible), and the make in the form of a convex polygon with rounded corners (FIG. 20)—even more. It should be noted that in the cases shown on FIG. 16 and FIG. 17, the circumferential shape of the axial line of the ring-shaped channel is not obligatory either—it is possible to use ring-shaped channels of the same shape as shown on FIG. 19, 20 or another shape subject to observance of the above inequation and the condition consisting in that the longitudinal axial line should be smooth (and, preferably, convex).

FIG. 21 and FIG. 22 show on enlarged scale two ring-shaped channels in the points of contact and crossing of their longitudinal axial lines 111*a*, 111*b*. It should be noted that the beams in the points of their interaction are, strictly speaking, counter or similarly directed only in the case illustrated on FIG. 16, when both beams propagate in the same ring-shaped channel, and in the case illustrated on FIG. 17 and FIG. 21, when the beams propagate in the channels contacting each other by their longitudinal axial lines. In the cases illustrated on FIGS. 18-20 and FIG. 22, where there is crossing of ring-shaped channels, the counter beams, in the points of their particles' interaction, actually have the directions, the angle between which is obtuse and close to 180 degrees, while the beams having the same direction ("pursuit" beams) have the directions, the angle between which is acute and close to zero.

Along with the afore-mentioned shapes of the axial line of the channels used in the suggested collider, the longitudinal axial line of the channel is acceptable that has the shape of any closed convex smooth line. In terms of the accomplished technical result provided by the suggested inventions, any specific cases of the shape of the longitudinal axial line meeting the above conditions are equivalent. This is explained by the fact that the functioning of the suggested collider is based on the physical principle that is different from the principle used in the means known from the art described above, namely, in order to form closed trajectories of charged particles in the ring-shaped channel, i.e. in order to keep them in the, and to "overcome" the volumetric charge of the beam (i.e. in order to ensure its focusing and prevent defocusing), the electrical field is used that is generated on the inner walls of the channel inside which the beams are moving (FIG. 16) of the beam (FIGS. 17-20) is moving. The said electrical field results from electrization of the inner surface of the channel wall by the charges of the same sign as the beam particles, which is created by the particles of the beam (beams) itself (themselves) injected into the channel, or occurring as a result of preliminarily done electrization, for instance, during manufacture of the channel walls from materials possessing electret properties.

EXAMPLE 6

Movement of the beams of particles with the charge equal to the charge of electron at energy E up to 100 MeV can be provided at the following geometric parameters: radius $R=2\cdot10^2$ cm (i.e. the outer dimension of the ring is 4 m), the channel wall thickness d=5 mm, the channel diameter h=2 mm (the channel wall is assumed to be made from glass with electric strength $U_{es}$ equal to $10^8$ V/m). In this case, inequation (6*) is fulfilled with considerable "reserve":

$$E/Q \leq 0{,}2RdU_{es}/h.$$

When the collider according to FIG. 16 is used, the particles of both beams A and B should have charges of the same sign (for example, electron-electron, proton-proton), both in case of counter beams and in case of beams moving in the same direction, because their movement takes places in the same channel and one and the same electrical field is acting on them. When colliders according to FIGS. 17-20 are used, the particles belonging to beams A and B may have charges of both similar and opposite sign, both to provide interaction of counter beams and to provide interaction of beams moving in the same direction.

In the cases when it is provided for using two ring-shaped channels to ensure interaction of the beams the particles of which have opposite charges, it is necessary to take into account that the wall of each of the channels in the zone of contact or crossing of their axial lines (where interaction between particles of those two beams will take place) should have a discontinuity. In this context, on FIG. 21, 22 the channel walls in the vicinity of crossing of their axial lines 111*a*, 111*b* are shown with dotted lines. For the case when charges of particles in two beams have opposite sign, such representation means that the wall of each of the channels is made with discontinuity in the said zone, and for the case of beams with particles of the same sign—that it is made without discontinuity. Presence of discontinuity of walls (i.e. absence of the parts of the walls together with the charges that could have been there) allows addressing the problem of generation in this zone of electric fields that could be equally acceptable for particles of opposite signs.

In all above-mentioned cases (except for counter beams in the same ring-shaped channel, FIG. 16), in each ring-shaped channel it is possible to implement additional acceleration of particles injected into it. To this end, the channel should be equipped with accelerating sections. Increase of the speed of charged particles movement along this channel may be realized by the known methods, for example, with the help of high-frequency fields; see also monograph [13], p. 6-83, 120-143. However, electrostatic acceleration can be realized easier and without losing the simplicity inherent in the suggested invention. Such acceleration is realized in accelerating sections taking the form of electrodes of different polarity, arranged in pairs along the channel, the first electrode in each pair in the direction of particles' movement being the electrode, which polarity is opposite to the sign of the charge of particles to be accelerated. On FIGS. 17-20 presence of such sections is schematically indicated by items 120, 121. On those figures, each channel contains only one accelerating section, but there may be several of them as well.

The accelerating sections may be present in the collider with one ring-shaped channel (FIG. 16) too. Their presence is not shown on that figure because it illustrates collider's use for provision of interaction of counter beams, while acceleration of the particles of both beams injected in the same channel according to FIG. 16 may be applied, as mentioned before, for "pursuit" beams only.

Use of the suggested collider with one ring-shaped channel with "pursuit" beams may be of interest itself in the important in terms of practice case of thermonuclear reactions: deuteron-deuteron, deuteron-tritium ion, etc. The advantage of this case that in this instance, the positive role of Larmor force caused by appearance of magnetic field around the current generated by the beam of charged particles and acting in the direction preventing Coulomb repulsion of particles is essential. This is connected with the fact that in case of "pursuit" beams, in contrast to counter beams, the corresponding Larmor forces do not compensate each other but are summed up. Hence, it is possible to achieve an additional increase of the density of interacting particles.

For additional increase of the particles' density (both in case of counter and "pursuit" beams) in the ring-shaped collider according to FIG. 1, one or several smooth constrictions 122 can be made, which appearance is shown on FIG. 23 (on that figure item 111 is the longitudinal axis of the channel, 112 is the channel wall). If there are such constrictions, interaction of particles belonging to the beams injected into the channel occurs mostly in the places of constrictions.

In a number of cases, preliminary accumulation of particles the beam of which is to be injected into the collider might be useful. Such accumulation can be made in the storage ring similar to the cyclic accelerator discussed above, the method of particles' output from the ring being similar to the method described there.

Injection of charged particles into the ring-shaped channels of the suggested collider in all cases of its make and use discussed above can be implemented using the means known in this art (see, for instance, monograph [13], vol. 1, p. 88, 104-105, vol. 2, p. 191). At the same time, in the suggested collider same as in the storage ring (and, besides, in the cyclic accelerator discussed above and the means for obtaining magnetic field that is discussed below), for injection of particles it is expedient to use the means described below.

This means (FIG. 24) represents a guiding structure 140 in the form of a channel for transportation of accelerated charged particles of the initial beam, which are injected into that channel through inlet hole 142 and output through outlet hole 143. The said channel has wall 144 made of the material capable of electrization, and rectilinear longitudinal axis 145. In this instance, channel 140 narrows down in the direction from the inlet to the outlet. Inner surface 148 of wall 144 of the channel is the surface of rotation round the longitudinal axis and its cross-section has the form of a circumference while its longitudinal section looks like two curves symmetrical relative to the longitudinal axis, each of them being an arch of a smooth curve with its concavity looking inside the channel. Along with such make of the channel, another make is possible when the inner surface of its wall is formed by two planar surfaces having the longitudinal section of the same shape as the sectional view of the top and bottom parts of wall 144 given on FIG. 24.

This guiding structure features the capability of capturing the beam of charged particles that is directed into its inlet hole and transporting it to the outlet hole with small losses while concurrently focusing it. To this end, the following condition should be observed:

$$E_1/Q_1<R_1d_1U_{es1}/h_1, \tag{8}$$

where $E_1$ is the energy of transported particles, $Q_1$ is their charge, $R_1$ is the least radius of curvature of the afore-mentioned arch of the smooth curve, $d_1$ is the least thickness of wall 144, $U_{es1}$ is the electrical strength of the wall material, $h_1$ is the channel diameter or the distance between the afore-mentioned planar surfaces at its outlet.

The physical values included in this correlation, same as in the correlations given above, are expressed in SI units, i.e. $[E_1]$=J, $[Q_1]$=C, $[U_{es1}]$=V/m, $[R_1]=[d_1]=[h_1]$=m. If energy E is expressed in off-system units electron-volts as it may be in this art, then charge Q should be expressed in the number of elementary charges (i.e. electron charges), it is divisible by.

EXAMPLE 7

At the length of glass ($U_{es1}=10^8$ V/m) channel equal to 10 cm, radius $R_1$ of curvature of the line that is the generatrix of the inner surface of the channel wall equal to 5 m, channel wall thickness $d_1$ equal to 1 mm, diameter $h_1$ of the channel in the inlet butt-end equal to 1 mm and that in the outlet—10 microns, the beam of electrons with energy E≤50 MeV passes through to the outlet almost without losses. In this instance $$E_1/Q_1\leq 0{,}1R_1d_1U_{es1}/h_1,$$

i.e. inequation (8) is fulfilled with a considerable "reserve".

The guiding structure according to FIG. 24 can be easily connected with ring-shaped channels of the collider and cyclic accelerator discussed above and the means for obtaining magnetic field discussed below. FIG. 25 shows such connection of two guiding structures 140*a*, 140*b* with ring-shaped channel 100 of a collider similar to that shown on FIG. 16 (the above-mentioned smooth joints are shown as items 155, 156). To this end, the wall of the channel of the said guiding structure in its outlet end is connected with the help of a smooth joint with the wall of the said ring-shaped channel on the side giving on the center of curvature of its longitudinal axis, with the possibility of injecting into that closed channel of accelerated charged particles through the hole in its wall made for the said connection.

Below are the comparative assessments giving an idea about the efficiency of the suggested collider.

The Large Hadron Collider in CERN uses particles accelerated to 5 TeV (i.e. $5\cdot10^{12}$ eV) in 3 or 4 stages. In using the suggested collider, it is possible to inject particles into it, which were obtained from a small accelerator with a relatively low particle energy (up to 1 MeV) and produce further acceleration of particles in the collider itself, as described above. It is feasible in principle and in terms of engineering, because the necessity of several stages in acceleration of particles for the Large Hadron Collider is connected with use in accelerators of magnetic fields, which cannot be the same fields for particles having substantially different energies (from the initial from which acceleration starts to the one that the particles should achieve). In the suggested collider that is free of using magnetic fields there are no obstacles for the particles to have various energies (from several keV to several TeV) during their movement in one and the same ring-shaped channel.

The main parameter of any collider is luminosity L (the proportionality factor between section S of the investigated process of interaction and the number of useful events per unit of time), determined by formula:

$$L=(n_An_B/S)f, \tag{10}$$

where $n_A$, $n_B$ is the density of particles (the number of particles in the unit of volume) in beams A and B, S is the beam cross-section area, f is the frequency of collisions of particles.

The particles' density in the known colliders realizing the principles described in monograph [13], including the Large Hadron Collider in CERN, is limited by their mutual repulsion caused by Coulomb interaction and does not exceed $10^9$ particles/cm$^3$. Coulomb interaction takes place in the suggested collider too. However, therein the particles are additionally experience repulsive force from the electrilized wall, which is compressing the beam of particles.

EXAMPLE 8

Let's find the density of particles in the channel of the suggested collider (ignoring the effect of Larmor forces), based on the condition of equality of the said counter-acting forces at a distance between particles equal to mean distance $r_m$ and assuming the particles' charge to be equal to electron charge e:

$$e^2/(4\pi\in_0r_m^2)=eU_{es}. \tag{11}$$

Here, $U_{es}$ is the electric strength of the material, which the wall of the collider channel is made from, $\in_0$ is the electric constant.

Density n as the number of particles in the unit of volume at mean distance $r_m$ between them equals to:

$$n=1/(4\pi r_m^3/3)\approx 1/(4r_m^3) \tag{12}$$

Having found $r_m$ from equation (11), subject to (12), we will obtain:

$$n=2(\pi\epsilon_0 U_{es}/e)^{3/2}. \quad (13)$$

Assuming $U_{es}=10^8$ V/m (for the channel made of glass), we will get that density n has an order of $10^{18}$ particles/cm$^3$.

So, when a material is used that features good electric strength, the density of particles in the channel of the suggested collider may exceed the density of particles in the known collider by several orders. Taking into account that luminosity formula (10) includes the product of two densities, luminosity is increased even greater. We would also observe that ignoring of the effect of Larmor forces does not introduce a considerable error taking into account the above-mentioned nature of this action for counter beams while for "pursuit" beams this ignoring acts only towards underestimation of luminosity.

One of the possible important applications of the suggested collider is increase of the yield of nuclear reactions.

Let's discuss it by example of the yield of thermonuclear neutrons in case of collision of deuterons with deuterons, or deuterons with tritium ions, etc.

In conventional neutron generators, during deuteron-tritium ion interaction, for instance, only one reaction per million of reactions is positive, that is it produced one thermonuclear neutron and one helium ion, the total energy yield being 17.6 MeV. Such small probability of yield of thermonuclear neutrons is conditioned by that the section of ions' interaction with the atom electron shell is approximately 6 orders higher than the nuclear section of deuteron-tritium ion interaction equal to $5\cdot10^{-24}$ cm$^2$. In case of counter beams, when the suggested method is used, interaction of stripped nuclei is taking place, that is the said value of interaction section of $5\cdot10^{-24}$ cm$^2$ takes place.

In order to make respective increase of the probability of yield of thermonuclear neutrons possible, a few additional conditions should be satisfied. Namely, at small elastic deviations ions should remain in the potential well. When tritium ion meets deuteron, it is sufficient for them to have energy of about 50 keV each. Estimates show that if the potential well has a depth of the same order, i.e. ~50 keV, then approximately 25% of particles will experience positive reaction. In this case, at the total energy loss of 0.4 MeV in four collisions, 17.6 MeV occur in the form of helium ion energy, i.e. the energy yield is increased 44 times approximately. In a number of cases, for instance, at the thickness of the channel wall made of glass of the order of several millimeters, it is quite possible to achieve the potential barrier of 50 keV. At the same time, it is necessary that the probability of nuclear reactions on counter beams would considerably exceed the probability of interaction of the particles of counter beams with the residual gas. This can be provided only on the condition of super-high vacuum ~($10^7$–$10^8$) particles/cm$^3$, which is also quite feasible.

So, subject to the presence of high vacuum and high potential well, it is possible to increase the yield of thermonuclear neutrons by several orders compared to the current situation in neutron generators.

In the practical realization of the possibility of obtaining positive energy yield through nuclear synthesis using the suggested collider, it is necessary to cool the outer surface of the ring-shaped channel, which wall is heated by fast neutrons, because heavy heating might lead to disappearance of the effect of electrization of the inner surface of the wall. Efficient cooling is possible with the help of various light refrigerants capable of absorbing fast neutrons, for instance, water. Besides, in order to increase the service life of the wall of the ring-shaped channel, which, in this case, plays the role of the first wall in the thermonuclear reactor, it is expedient to use dielectrics with small ion sputtering factor, for instance, amorphous glass, for its fabrication.

It is also expedient to increase the surface of the wall of the collider's ring-shaped channel. If, for instance, the released power is of the order of 10 MW, then approximately 2 MW (i.e. about 20%) falls on helium ions that are absorbed on the collider wall. At practically permissible thermal load (50–100) W/cm$^2$ it means that the surface area of the collider wall should be of the order of $(2–4)\cdot10^4$ cm$^2$. At the outer diameter (h+2d) of the ring-shaped channel of the collider equal to 40–80 mm, such surface area is correspondent to the length of the collider axial line of 10 m approximately, that is radius R of the longitudinal axial line of the collider ring should be about 1.5 m.

The collider, as a source of neutrons, can be used for transmutation of long-lived radioactive waste. In this instance, the containers for such waste are placed in the zone of most intensive release of neutrons. If the collider is made as a single ring-shaped channel, then the said containers may be arranged around that channel along its whole perimeter, or, if there are constrictions 112 as shown on FIG. 23,—near such constrictions. If the collider is made as two ring-shaped channels with crossing or contacting each other longitudinal axial lines 111*a*, 111*b*, then the containers may be place near such points of contact or crossing as shown on FIG. 21, 22.

The given examples, together with the fact that the suggested collider is free of the necessity of using magnetic fields (in the Large Hadron Collider 1624 superconductive magnets at a temperature of −271° C. are used), confirms the efficiency and simplicity of collider realization.

The last one of the suggested inventions refers to the means for obtaining magnetic field generated by the current of accelerated charged particles.

This means also uses the suggested device for changing the movement direction of a beam of accelerated charged particles. In this case, it performs the role of a closed tract through which the beam of accelerated charged particles is moving and is similar by function to the closed live coil or several coaxial coils connected in sequence. To this end, in the suggested means the said device contains the bent channel for transportation of accelerated charged particles, which wall is made of the material capable of electrization. This channel is made with its longitudinal axis having the shape of a smooth line, which least radius R of curvature is related to the highest energy E and the charge Q of the beam of particles, for operation with which this means for obtaining magnetic field is designed, by the following correlation including also the least thickness d of the channel wall, electric strength $U_{es}$ of the channel wall material and the longest distance h between two points of the channel interior surface, which are located in the channel cross-section on one and the same normal to the said surface:

$$E/Q<RdU_{es}/h. \quad (7^*)$$

At that, the channel is made closed. Besides, the suggested device contains the injector for injection of accelerated charged particles into the channel.

The above inequation (7*) meets condition (7). Its observance provides beam focusing in the channel and its movement along the trajectory, which shape corresponds to the shape of the closed channel, without losses caused by contact with the wall.

FIG. 26 shows the make of the suggested device, wherein its channel 171 is made with longitudinal axis 172 representing one closed contour looking like a smooth flat line (on the shown drawing it is the circumference with radius R, which is depicted only partially); item 173 demonstrates the injector. In the right part of FIG. 26 the cross-section of channel 171 is shown and dimensions h and d are given. There, the arrows show the preferable places for injecting the beam of accelerated charged particles. Channel 171 is equipped with sections of electrostatic acceleration, each of them containing a pair 174 of electrodes. In this instance, the channel make as a convex curve (a special case of which is the circumference) allows ensuring fulfillment of condition (7*) at the smallest dimensions of the suggested means.

Figure 27:
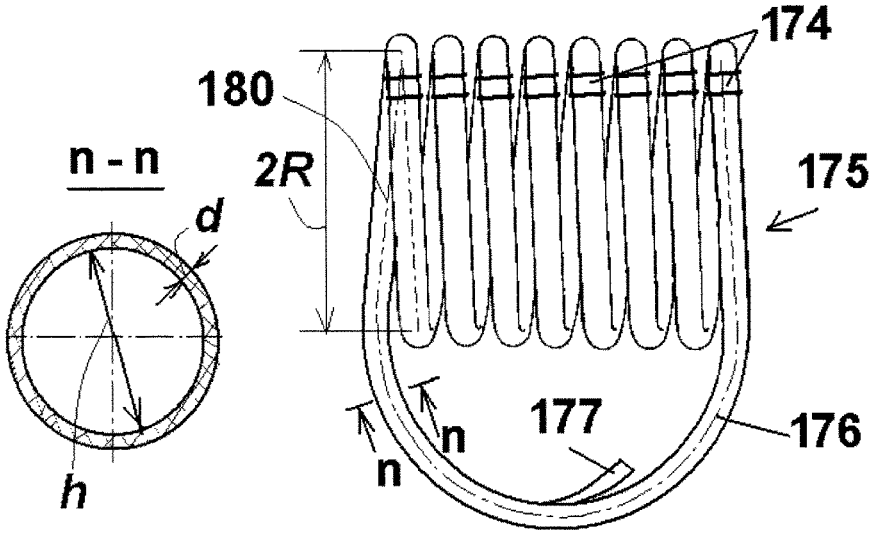

FIG. 27 shows another specific case of the make of the suggested means, wherein channel 175 has the longitudinal axis (shown only partially) in the form of cylindrical spiral 180, which ends are interconnected with arch 176. The latter has a radius exceeding the radius R of curvature of spiral coils and, hence, the above condition is knowingly fulfilled for it. Same as on FIG. 26, on FIG. 27 item 174 shows pairs of electrodes of the sections of electrostatic acceleration. In the left part of FIG. 27 the picture of the cross-section of channel 175 is given and dimensions d and h are shown.

At the same, as in the device according to FIG. 26, beam current in the channel and radii R of curvature of its longitudinal axis, the device according to FIG. 27 allows increasing the magnetic field induction.

Magnetic fields are known to be widely used in the contemporary machinery (in particular, in electric motors and electric generators) and scientific research. At that, the task of obtaining strong magnetic fields remains topical. The known means of this designation are characterized by large dimensions and weight as well as power consumption. The suggested device is quite light and compact. For instance, a glass ring with the diameter of its longitudinal axial line 2R=100 cm and inner diameter h=3 mm, having the wall thickness d=6 mm, weights a bit more than one kilogram. In such ring it is easy to create a field with induction of 3–5 Tesla and over.

Fields with that kind of induction can be used to create a new type of magnetic tomographs that will differ not only by their low price but also by that they will be very "thin" so the patient's won't have any problems related to claustrophobia.

The current in the closed channel of the suggested device is adjustable; hence, it is possible to have the induction of the generated magnetic field changed in time following the desired law. This creates premises for future use of the device, in particular, for creation of induction accelerators of charged particles.

Thanks to small dimensions and low weight of the suggested device, future application in space equipment might be expected.

An interesting application of the suggested device for magnetic field general may be transport systems with the magnetic cushion. Such systems utilizing the suggested device can turn out significantly cheaper.

The suggested device that allows obtaining strong magnetic fields can prove very efficient for acceleration of nano and micro particles and small objects to high speeds, in particular, for their launch into space.

An important application of strong magnetic fields is their use for plasma retention at high temperatures of the order of 100 million degrees. The best known project is ITER—tokamak, where plasma is retained in the toroidal field. Plasma retention requires fields with induction of the order of 5–10 Tesla. Similar fields are also needed in the so-called magnetic mirror (see, for example: D. D. Ryutov. Open traps. "The Advances of Physical Sciences", 1988, April, Vol. 154, Issue. 4, p. 565-614 [20]). FIG. 28 reproduces the figure from paper [20], which schematically depicts the tokamak (on the left) and the magnetic mirror (on the right); item 181 designates the coils for generating magnetic field. Both in the tokamak and in magnetic mirror, each of coils 181 can be replaced with the ring according to the suggested invention shown on FIG. 26.

Nevertheless, it is more rational to use in the tokamak the suggested means for obtaining the magnetic field generated by the current of accelerated charged particles, the make of such being as shown on FIG. 29. In this instance, the suggested device has channel 190 with its longitudinal axis having the form of a closed spiral wound over a torus, which creates the toroidal magnetic field. As in the cases illustrated on FIG. 26, 27, on FIG. 29 item 174 depicts pairs of electrodes of the sections of electrostatic acceleration; item 182 depicts the injector. In the right part of FIG. 29 the cross-section of channel 181 is shown and dimensions h and d included in condition (7*) are given.

In the probkotron, the totality of coils can be replaced with a closed spiral-like channel similar to that shown of FIG. 27, wherein the diameter of spiral loops vary following the same law as the diameter of coils 181 shown in the right part of FIG. 28.

EXAMPLE 9

To obtain the magnetic field with induction of 6 Tesla according to FIG. 26 with the diameter of the longitudinal axial line R=20 cm, current of the order of $10^6$ Amperes is required. Such current can be created in the ring-shaped channel for 1 second approximately at electron energy of 100 keV and injection current of $10^{-2}$ A. Such currents can be easily produced using modern electronic guns. The channel is assumed to have super-high vacuum at a level not worse than $10^{-12}$ atm.

In each pair 174 of electrodes of the sections of electrostatic acceleration, the first electrode in the direction of particles' movement is the electrode, which polarity is opposite to the sign of particles' charge. As the latter, both electrons, and protons and ions can be used. The beam of particles can be injected into the channel in the same way as this is done in the suggested cyclic accelerator and collider. In particular, this can be accomplished using the guiding structure described above and shown on FIG. 24. It is more expedient to mount the injectors as shown on FIG. 26, 27, 29, so that injection of particles into the channel would take place through the wall side giving on the center of curvature of the longitudinal axis of the channel (that is the opposite side relative to the side against which the beam is "squeezed up" while moving through the channel.)

Fulfillment of the above conditions (1)-(8), (2*)-(7*) in the suggested method and devices is, as a rule, not difficult. In practice, it is expedient to use more stringent conditions, where, in contrast to the listed conditions, the left parts of inequations are less than the right ones 5÷10 times, as is the case in the included examples.

SOURCES OF INFORMATION

1. Electronics. Encyclopedic Dictionary. Moscow, Publishing House "Sovetskaya Encyclopedia" (p. 339, 357-358, 572).
2. Physical Encyclopedia. Publishing House "Bolshaya Rossiiskaya Encyclopedia", Moscow, 1998 (vol. 3, p. 241, 406-409; vol. 5, p. 246-253).
3. N. F. Shul'ga, V. I. Truten', I. V. Kirillin. Passage of the Beams of Fast Charged Particles through the Bent Crystal.

"Herald of the Kharkiv University", No. 887, 2010, Physical series "Nuclei, Particles, Fields", issue 1/45/, p. 54-64.

4. USSR Inventor's Certificate No. 1064792 published 15 Jan. 1985.
5. The physics of the beams of charged particles and accelerating technique. "News and Problems of Fundamental Physics". State Research Center of the Russian Federation The Institute of Physics of High Energies (Protvino), 2010, No. 1(8), p. 28-39.
6. N. Stolterfoht, V. Hoffmann, R. Hellhammer at al. Guided transmission of 3 keV $Ne^{7+}$ ions through nanocapillaries etched in a PET polymer. "Nuclear Instruments and Methods in Physics Research Section. B: Beam Interactions with Materials and Atoms", Volume 203, April 2003, p. 246-253.
7. K. A. Vokhmyanina. Control of the beams of positive ions using dielectric channels. Dissertation for the degree of the candidate of physico-mathematical sciences. Moscow, MGU, 2007, p. 19-21, 81-96.
8. Patent Application of Japan No. 2005-185522 published 11 Jan. 2007.
9. Wei Wang, Dejun Qi, Deyang Yu at al. Transmission of low-energy electrons through $SiO_2$ tube. "Journal of Physics: Conference Series", 163 (2009) 012093 (IOP Publishing), p. 1-4.
10. F. F. Komarov, A. S. Kamyshan, Cz. Karwat. A fine structure in angular distributions of protons transmitted through insulating capillaries. "Vacuum" 83 (2009), p. 51-53.
11. Reference Manual on Electro-Engineering Materials. Eds. Yu. V. Koritsky, B V. V. Pasynkov, B. M. Tareev. Vol. 2, p. 207, FIGS. 22-11. Moscow, Energoatomizdat, 1987.
12. Russian Federation Patent for Invention No. 1828382 published 20 May. 1995.
13. A. N. Lebedev, A. V. Shalnov. Basic Physics and Techniques of Accelerators. Moscow, Energoizdat, 1981, vol. 1, p. 6-83, 88, 104-105, 111-114, 120-143; vol. 2, p. 191.
14. Russian Federation Patent for Invention No. 2312473 published 10 Dec. 2007.
15. Russian Federation Patent for Invention No. 2265974 published 10 Dec. 2005.
16. Russian Federation Patent for Invention No. 2187219 published 10 Aug. 2002.
17. Russian Federation Patent for Invention No. 2237297 published 27 Apr. 2004.
18. Russian Federation Patent for Utility Model No. 46121 published 10 Jun. 2005.
19. Electrets. Ed. H. Sessler, Moscow, Publishing House "Mir", 1983, p. 32-54.
20. D. D. Ryutov. Open traps. "Advances of Physical Sciences", 1988, April, vol. 154, issue 4, p. 565-614.

The invention claimed is:

1. A collider for controlling two beams of preliminarily accelerated charged particles with creation of conditions for interaction of the particles belonging to different beams, the collider contains:

means for injection of the beams, and two closed ring-shaped tracts, the tracts crossing or contacting each other with their longitudinal axial lines, and characterized in that each of the tracts is a device for changing a direction of movement of a respective beam of accelerated charged particles, wherein the device contains a bent channel for transporting the particles, a wall of the bent channel is made of a material capable of electrization, the bent channel is a closed ring, and the bent channel has a longitudinal axis having a shape of a smooth line of a least radius R of curvature, which is correlated with a highest energy E and a charge Q of the particles, by a ratio:

$E/Q<RdU_{es}/h$, wherein d is a least thickness of the wall, $U_{es}$ is an electric strength of the wall material, and h is a longest distance between two points of an inner surface of the wall located in a cross-section of the channel on a same normal to the inner surface;

wherein electrization of the wall with a charge sign equal to a sign of charge of the beam of accelerated charged particles causes transport of the beam of accelerated charged particles through the bent channel; and the collider does not include magnets that control the direction or the transport of the beams.

2. The collider according to claim 1, wherein the smooth line, which is a longitudinal axial line of the channel, is convex.

3. The collider according to claim 2, wherein the means for injection of the beams are mounted so as to enable injection of the beams into the one or two channels on a side looking toward a center of curvature of the convex smooth line, which is the longitudinal axis of the respective channel.

4. The collider according to any of claims 2, 3, and 1, wherein at least one of the channels is equipped with means for additional acceleration of particles moving in that channel.

5. The collider according to claim 4, wherein the means for additional acceleration of the particles in the channel are made electrostatic as electrodes of opposite polarity arranged in pairs along that channel so that in each pair a first, in a direction of movement of the particles, electrode is the electrode which polarity is opposite to a sign of charge of the particles in that channel.

6. The collider according to any of claims 2, 3, 5, and 1, wherein when the collider is used to obtain intensive thermonuclear neutrons at a collision of beams of deuterons and tritium ions, the collider is equipped with means for cooling the walls of the channels.

7. The collider according to claim 6, wherein when the collider is used as a source of neutrons for transmutation of long-lived radioactive waste, the collider is equipped with containers for such waste that are located in a zone of a most intensive output of neutrons.

8. A method of changing a direction of movement of a beam of accelerated charged particles having a specified charge Q and an energy E, comprising:

(a) injecting the beam of accelerated charged particles into a bent channel, the bent channel is a closed ring, the bent channel having a wall made of a material capable of electrization, and the bent channel includes:

a smooth line longitudinal axis having a least radius of curvature R, a least thickness d of the wall, and a longest distance h between two points of an inner surface of the wall located in a cross-section of the bent channel on a same normal to the inner surface, and an electric strength $U_{es}$ of the bent channel wall material, wherein the energy, charge, least radius of curvature, least thickness of the wall, longest distance between two points of an inner surface of the wall, and electric strength of the wall material satisfy the inequality:

$E/Q<RdU_{es}/h$; and (b) transporting the beam of accelerated charge particles through the bent channel by electrization of the wall with a charge sign equal to a sign of a charge of the beam of accelerated charged particles, wherein a pressure of less than or equal to $10^{-12}$ atm is provided in the bent channel during transporting of the beam, wherein the transporting of the beam of accelerated charged particles is carried out without use of magnets to control the direction or the transport of the beam, and wherein transporting of the beam of accelerated charged particles is carried out without blocking of the bent channel.

* * * * *